US011174729B2

(12) United States Patent
Falk et al.

(10) Patent No.: US 11,174,729 B2
(45) Date of Patent: Nov. 16, 2021

(54) INFLOW TESTING SYSTEMS AND METHODS FOR OIL AND/OR GAS WELLS

(71) Applicant: SOURCE ROCK ENERGY PARTNERS INC., Calgary (CA)

(72) Inventors: Kelvin Falk, Calgary (CA); Brandon Yorgason, Rockyford (CA); Matthew Thauberger, Balgonie (CA); Nicholas Thauberger, Estevan (CA)

(73) Assignee: Source Rock Energy Partners Inc., Calgary (CA)

( * ) Notice: Subject to any disclaimer, the term of this patent is extended or adjusted under 35 U.S.C. 154(b) by 107 days.

(21) Appl. No.: 16/164,064

(22) Filed: Oct. 18, 2018

(65) Prior Publication Data

US 2019/0178079 A1 Jun. 13, 2019

Related U.S. Application Data

(60) Provisional application No. 62/625,583, filed on Feb. 2, 2018, provisional application No. 62/598,118, filed on Dec. 13, 2017.

(51) Int. Cl.
*E21B 49/10* (2006.01)
*E21B 47/10* (2012.01)
(Continued)

(52) U.S. Cl.
CPC ..... *E21B 49/10* (2013.01); *E21B 43/12* (2013.01); *E21B 43/38* (2013.01); *E21B 47/10* (2013.01);
(Continued)

(58) Field of Classification Search
CPC ..... E21B 49/08; E21B 49/086; E21B 49/087; E21B 49/10; E21B 47/10; E21B 43/12; E21B 43/26; E21B 43/38; F04F 5/48
See application file for complete search history.

(56) References Cited

U.S. PATENT DOCUMENTS 5,287,741 A * 2/1994 Schultz ..... E21B 49/088 166/250.17
5,291,947 A * 3/1994 Stracke ..... E21B 33/1243 166/187
(Continued)

FOREIGN PATENT DOCUMENTS

CA 3014868 A1 8/2017
CA 2 971 030 A1 12/2017
(Continued)

OTHER PUBLICATIONS

International Search Report in corresponding Application No. PCT/CA2018/051308, dated Jan. 15, 2019, (6 pages).
(Continued)

*Primary Examiner* — Natalie Huls
(74) *Attorney, Agent, or Firm* — Bookoff McAndrews, PLLC

(57) ABSTRACT

Systems and methods for testing one or more closeable or fixed ports in a horizontal section of a well are provided. One of the systems comprises a jointed tubing string deployable by a service rig and a bottomhole assembly attached the jointed tubing string, the bottomhole assembly comprising a jet pump, a pressure sealing device, and an intake. The system may further include one or more of a shifting tool, a casing collar locator, an extension tubing, and an isolation device. The system draws fluid from the ports through the intake and the fluid may be tested as it flows through the buttonhole assembly and/or at surface. The isolation device may have a lower portion that is detachable from and re-attachable to the remaining components of the bottomhole assembly thereabove.

23 Claims, 13 Drawing Sheets

(51) Int. Cl.

| | |
|---|---|
| ***F04F 5/48*** | (2006.01) |
| ***E21B 49/08*** | (2006.01) |
| ***E21B 43/38*** | (2006.01) |
| ***E21B 43/12*** | (2006.01) |
| ***E21B 43/26*** | (2006.01) |

(52) U.S. Cl.
CPC ..... *E21B 49/08* (2013.01); *E21B 49/086* (2013.01); *F04F 5/48* (2013.01); *E21B 43/26* (2013.01)

(56) References Cited

U.S. PATENT DOCUMENTS

| | | | | |
|---|---|---|---|---|
| 6,951,331 | B2 * | 10/2005 | Haughom | E21B 34/06 251/180 |
| 8,307,893 | B2 | 11/2012 | Sierra et al. | |
| 8,511,394 | B2 * | 8/2013 | Themig | E21B 43/12 166/387 |
| 9,051,810 | B1 * | 6/2015 | Cuffe | E21B 43/26 |
| 9,234,412 | B2 | 1/2016 | Getzlaf et al. | |
| 9,605,531 | B2 | 3/2017 | Xin et al. | |
| 9,745,826 | B2 | 8/2017 | Getzlaf et al. | |
| 2004/0050548 | A1 * | 3/2004 | Dybdahl | E21B 49/081 166/264 |
| 2009/0159337 | A1 * | 6/2009 | Alberty | E21B 47/10 175/48 |
| 2010/0089141 | A1 * | 4/2010 | Rioufol | G01F 15/00 73/152.28 |
| 2011/0067883 | A1 * | 3/2011 | Falk | E21B 43/124 166/369 |
| 2011/0284214 | A1 * | 11/2011 | Ayoub | E21B 43/26 166/177.5 |
| 2012/0168153 | A1 * | 7/2012 | Joseph | E21B 47/00 166/250.03 |
| 2013/0084194 | A1 * | 4/2013 | Falk | F04B 51/00 417/53 |
| 2016/0084028 | A1 * | 3/2016 | Themig | E21B 23/02 166/255.1 |
| 2017/0051605 | A1 * | 2/2017 | Jackson | E21B 47/10 |
| 2018/0363460 | A1 * | 12/2018 | Fitzel | E21B 47/10 |
| 2019/0153841 | A1 * | 5/2019 | Randall | E21B 43/26 |
| 2020/0116009 | A1 * | 4/2020 | Marcuccio | E21B 49/081 |
| 2020/0217189 | A1 * | 7/2020 | Petrella | E21B 43/12 |
| 2020/0224528 | A1 * | 7/2020 | Fripp | E21B 47/06 |
| 2020/0284128 | A1 * | 9/2020 | Lan | G01N 9/36 |

FOREIGN PATENT DOCUMENTS

| | | | |
|---|---|---|---|
| CN | 104500057 | A | 4/2015 |
| CN | 105178947 | A | 12/2015 |
| CN | 105569635 | A | 5/2016 |
| WO | 2013/003958 | A1 | 1/2013 |

OTHER PUBLICATIONS

International Preliminary Report on Patentability in corresponding Application No. PCT/CA2018/051308, dated Jun. 16, 2020 (5 pages).

* cited by examiner

INFLOW TESTING SYSTEMS AND METHODS FOR OIL AND/OR GAS WELLS

CROSS REFERENCES

This Application claims priority to U.S. Provisional Patent Application No. 62/598,118, entitled "Zonal Isolation and Inflow Systems for Horizontal Wells", filed Dec. 13, 2017, and U.S. Provisional Patent Application No. 62/625,583, entitled "Dual, Detachable Zonal Isolation and Inflow Testing Methodology for Horizontal Wells", filed Feb. 2, 2018, both of which are hereby incorporated by reference in their entirety.

FIELD OF THE INVENTION

This disclose generally relates to oil and/or gas production. More specifically, the disclosure relates to systems and methods for testing an oil and/or gas well that has been completed with one or more frac ports and/or production ports.

BACKGROUND OF THE INVENTION

Wells having sections that deviate from a vertical orientation are now common for oil and/or gas production. Such wells are usually referred to as horizontal wells, each of which includes at least one section that is non-vertical, lateral, deviated, and/or near or substantially horizontal (collectively referred to herein as "horizontal sections"). Horizontal wells are first cased and then perforated or otherwise opened in intervals at specific locations to provide a series of production ports or frac ports (collectively referred to as ports). Next a portion or all of the horizontal section of the well can be subjected to a fracturing operation at the frac ports which generates cracks within a geological formation surrounding the horizontal section. The cracks provide a fluid pathway for facilitating fluid communication between the wellbore and an oil and/or gas containing reservoir within the geological formation.

The cracks tend to follow the path of least resistance in the geological formation, which results in complex flow paths for the fluids to flow from the reservoir to the wellbore of the horizontal section. Accordingly, different portions of the same geological formation may respond differently to the fracturing operation. This can result in different production rates among the different ports of the horizontal section. The width of the fracture, the tortuosity of the fluid path, and the amount of proppant in the fracture can all affect the production rate of fluids through a given production port.

Further, one or more ports of the horizontal section may produce water from the geological formation. For example, one port may be in fluid communication with a water layer and produce more water than other ports in the horizontal section. Too much water production can be detrimental to the economic performance of the well. While it is desirable to undertake a water shut-off operation (such as using gel fluids or mechanical shut-off devices) to minimize the production of water, it is difficult to assess which of the production ports are contributing to the water production in the first place.

Also, there are oil and/or gas production sites where some of the wells are used as water injection wells for flooding the target reservoir to push oil and/or gas towards the other wells which are designated as production wells (also referred to as "producers"). On these sites two or more wells are drilled parallel to one another, with one well acting as the water injection well and the others as the oil and/or gas producers. In this manner, water is pumped down the injection well and is pushed down and out into the formation. The spread of the water into the formation helps sweep residual oil and/or gas to each of the nearby production wells. This is a common enhanced recovery method on many oil and/or production sites.

However, one issue with this enhanced recovery method is the ability to control where the water is injected along the wellbore (usually the horizontal section) of the injection well. With uncontrolled water injection, often almost all of the water will be injected into the formation through one or two ports along the horizontal section, resulting in uneven injection through the reservoir which may lead to early water breakthrough at the producer, as a majority of the remaining oil and/or gas in the reservoir is bypassed.

Various improvements have been made with injection control devices (ICDs) for controlling the rate and location of downhole water injection. Also, because water is injected from surface, it is relatively easy to monitor the performance of the ICDs, and to make any required adjustments. However, within the reservoir there can still be preferential channeling of the water and as such water breakthrough can occur at one or more inflow ports along the horizontal section of the producer.

Accordingly, there is a need for systems that allow a well operator to determine which port(s) in a production well have the highest water production rates and which have the highest oil and/or gas production rates. Given that information, a focused approach can be used to shut off the inflow from the high water rate ports, while leaving the high oil and/or gas producing ports open in order to help maximize production.

Canadian Patent Application No. 2,971,030, titled "Apparatus and Method for Testing an Oil and/or Gas Well with a Multiple-Stage Completion," provides an apparatus and method that address some of the above issues. However, the apparatus and method disclose therein are only designed to be used with coiled tubing, as an electrical conductor is required to be pre-installed in the fixed-length continuous coiled tubing for the operation of such apparatus and method. Some well sites use service rigs as opposed to coiled tubing due to the high cost of the latter. A service rig workstring is made of many separate fixed-length (usually about 30 feet) tubings that are stacked and delivered to the well site on a truck. The separate tubings are then connected end-to-end on site by the service rig to form a workstring (also referred to as a "jointed tubing string"). As such, an electrical conductor cannot be pre-installed in a jointed tubing string. Accordingly, there is a need for technology that is compatible with service rigs and jointed tubing strings for testing various portions of the horizontal section of completed wells.

SUMMARY OF THE INVENTION

The present disclosure provides systems and methods for selective inflow component determination and flow rate and pressure measurement of each port in a horizontal section to help maximize oil and/or gas production in horizontal wells. The systems and methods provided herein are configured for operation with conventional service rigs.

According to a broad aspect of the present disclosure, there is provided a system for testing one or more ports in a horizontal section of a well, each of the ports having a corresponding sleeve for opening and closing same, the system comprises: a jointed tubing string deployable by a service rig, the jointed tubing string having an inner bore extending therethrough; a bottomhole assembly having a first end connectable to the jointed tubing string, the bottom hole assembly comprising: a jet pump in fluid communication with the inner bore; a pressure sealing device comprising a sealing element; a shifting tool for selectively engaging the sleeves to open or close same; and an intake for receiving fluid therethrough, the intake being in fluid communication with the jet pump; and one or both of: (i) surface testing equipment for testing the received fluid at surface and a downhole pressure and temperature recorder at or near the intake; and (ii) a production logging tool, the production logging tool being in fluid communication with the intake.

According to another broad aspect of the present disclosure, there is provided a system for testing one or more ports in a horizontal section of a well, the system comprising: a jointed tubing string deployable by a service rig, the jointed tubing string having an inner bore extending therethrough; a bottomhole assembly having a first end connectable to the jointed tubing string, the bottom hole assembly comprising: a jet pump in fluid communication with the inner bore; a pressure sealing device comprising a sealing element; a casing collar locator; an extension tubing; an intake for receiving fluid therethrough, the intake being in fluid communication with the jet pump via the extension tubing; and an isolation device comprising an upper portion having an upper sealing element and a lower portion having a lower sealing element, wherein the intake is positioned between the upper and lower portions; and one or both of: (i) surface testing equipment for testing the received fluid at surface; and (ii) a production logging tool, the production logging tool being in fluid communication with the intake.

According to another broad aspect of the present disclosure, there is provided a method for testing inflowing fluid from one or more test ports in a well, the one or more test ports being in an open position, the method comprising: connecting a bottomhole assembly to a jointed tubing string, the bottomhole assembly comprising a jet pump, a pressure sealing device, and an intake in fluid communication with the jet pump; running the jointed tubing string and the bottom hole assembly into the well using a service rig until the bottom hole assembly reaches the one or more test ports; if there are one or more closeable ports uphole from the one or more test ports, closing the one or more closeable ports while the bottomhole assembly advances into the well; setting the pressure sealing device, the pressure sealing device being uphole from the one or more test ports; supplying power fluid to the jet pump to draw the inflowing fluid into the intake; combining the inflowing fluid received through the intake with the power fluid to form a return fluid; transporting the return fluid to surface; and one or both of: testing the inflowing fluid as it flows through the bottomhole assembly; and testing the inflowing fluid at surface using surface testing equipment.

According to another broad aspect of the present disclosure, there is provided a method for testing inflowing fluid from one or more test ports in a well, the one or more test ports being in an open position, the method comprising: connecting a bottomhole assembly to a jointed tubing string, the bottomhole assembly comprising a jet pump, a pressure sealing device, an isolation device comprising an upper portion and a lower portion; and an intake in fluid communication with the jet pump via an extension tubing, the intake being positioned between the upper and lower portions; running the jointed tubing string and the bottom hole assembly into the well using a service rig until the lower portion is downhole from the one or more test ports; setting the lower portion of the isolation device; setting the pressure sealing device and the upper portion of the isolation device; supplying power fluid to the jet pump to draw the inflowing fluid into the intake; combining the inflowing fluid received through the intake with the power fluid to form a return fluid; transporting the return fluid to surface; and one or both of: testing the inflowing fluid as it flows through the bottomhole assembly; and testing the inflowing fluid at surface using surface testing equipment.

According to another broad aspect of the present disclosure, there is provided a system for performing a water shut-off treatment on one or more ports in a well, the system comprising: a jointed tubing string deployable by a service rig, the jointed tubing string having an inner bore extending therethrough; and a bottomhole assembly having a first end connectable to the jointed tubing string, the bottom hole assembly comprising: a casing collar locator; an outlet in fluid communication with jointed tubing string; and an isolation device comprising an upper portion having an upper sealing element and a lower portion having a lower sealing element, wherein the outlet is positioned between the upper and lower portions.

According to another broad aspect of the present disclosure, there is provided a method for performing a water shut-off treatment on one or more ports in a well, the to one or more test ports being in an open position, the method comprising: connecting a bottomhole assembly to a jointed tubing string, the bottomhole assembly comprising an isolation device comprising an upper portion and a lower portion; and an outlet in fluid communication with the jointed tubing string, the outlet being positioned between the upper and lower portions; running the jointed tubing string and the bottom hole assembly into the well using a service rig until the lower portion is downhole from the one or more ports; setting the lower portion of the isolation device; setting the upper portion of the isolation device; and supplying treatment fluid down the jointed tubing string and allowing the treatment fluid to flow out through the outlet for a period of time.

BRIEF DESCRIPTION OF THE DRAWINGS

The invention will now be described by way of an exemplary embodiment with reference to the accompanying simplified, diagrammatic, not-to-scale drawings. Any dimensions provided in the drawings are provided only for illustrative purposes, and do not limit the invention as defined by the claims. In the drawings:

DETAILED DESCRIPTION OF THE INVENTION

The present disclosure provides systems and methods for testing an oil and/or gas well that has been completed with one or more frac ports and/or production ports. In some embodiments, the systems and methods disclosed herein incorporate a jet pump and pressure isolation equipment to isolate one or more ports to test reservoir fluids flowing therethrough. The one or more ports may be fixed (i.e. permanently open ports) or closeable (i.e. ports equipped with closeable sleeves or the like).

In the present disclosure, the words "lower," "upper," "above," "below," and variations thereof denote positions of objections relative to the wellbore opening at surface, rather than to directions defined by gravity. For example, "lower" should be interpreted to mean further downhole away from the wellbore opening and "upper" should mean further uphole towards the wellbore opening.

Figure 1A:
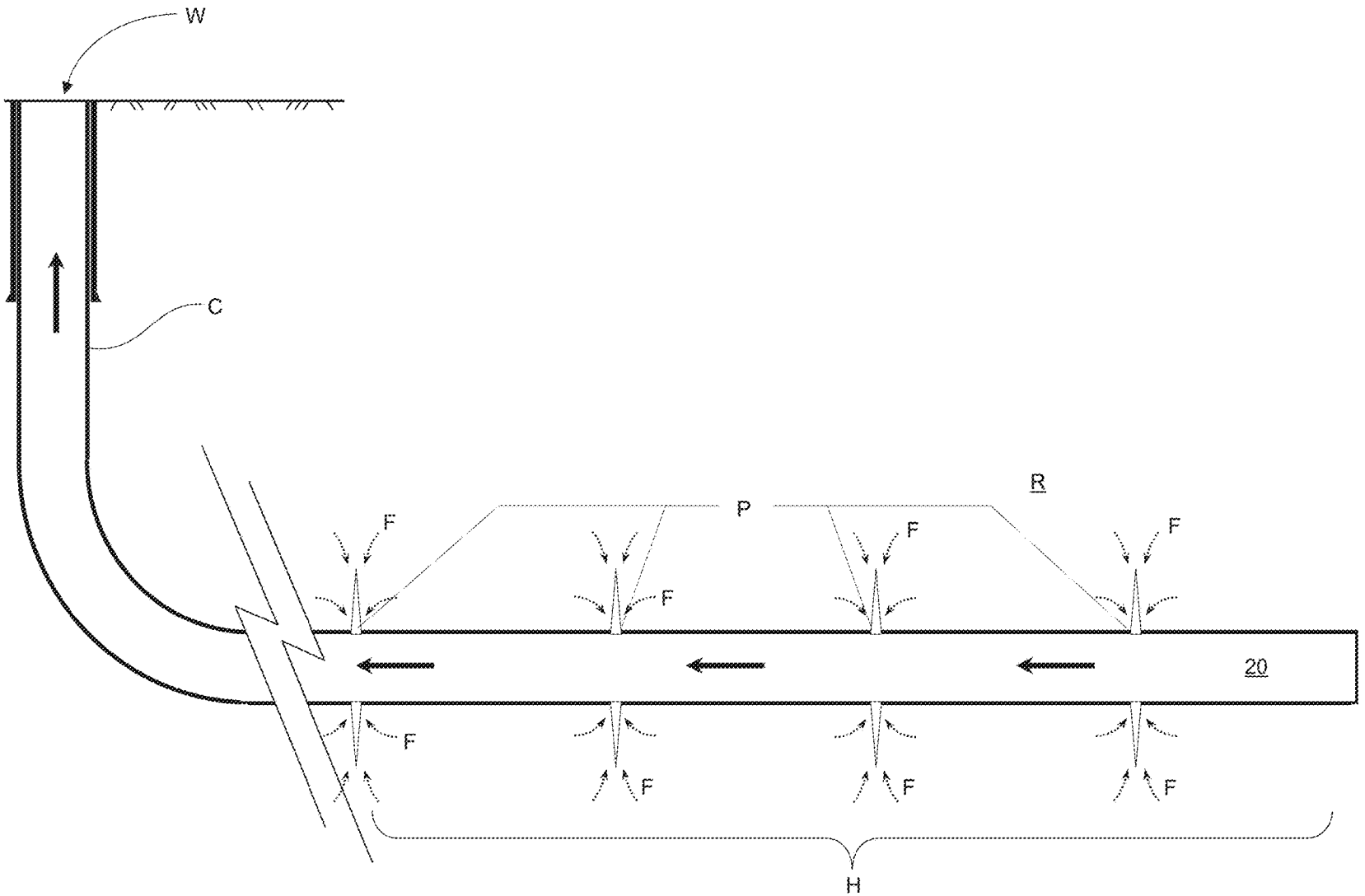
FIG. 1A is a schematic representation of a horizontal oil and/or gas well having a horizontal section completed with fixed ports.

FIG. 1A shows a sample horizontal well W completed with a well casing C and having a horizontal section H, at least a portion of which extends through a subterranean reservoir R. The horizontal section H is completed with fixed open ports P that allow reservoir fluid F to flow therethrough and enter the wellbore 20 in the horizontal section to be produced to surface. The horizontal section may be open hole or lined with a liner, casing or other type of well pipe that is known in the art.

Figure 1B:
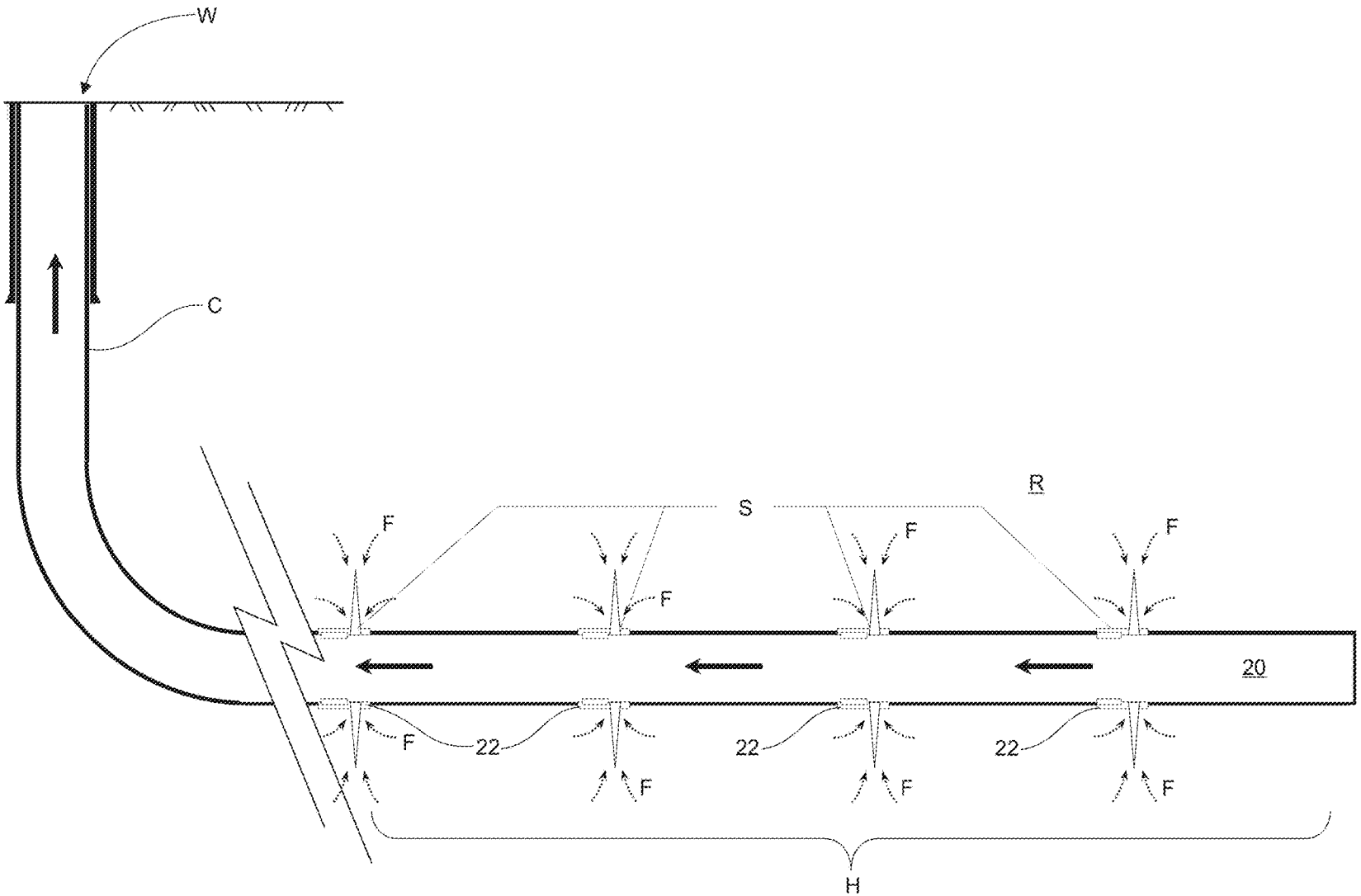
FIG. 1B is a schematic representation of an oil and/or gas horizontal well having a horizontal section completed with selectively closeable ports.

FIG. 1B shows another sample horizontal well W having the same features as the well in FIG. 1A except the horizontal section H is completed with selectively closeable ports S. In the illustrated embodiment, the ports S are set in the open position. A device, such as a mechanical sleeve 22, is provided at each port S for selectively opening and closing the ports S. When one or more ports S are open, fluid F from the reservoir R can flow into the wellbore 20 for production to surface.

Figure 2:
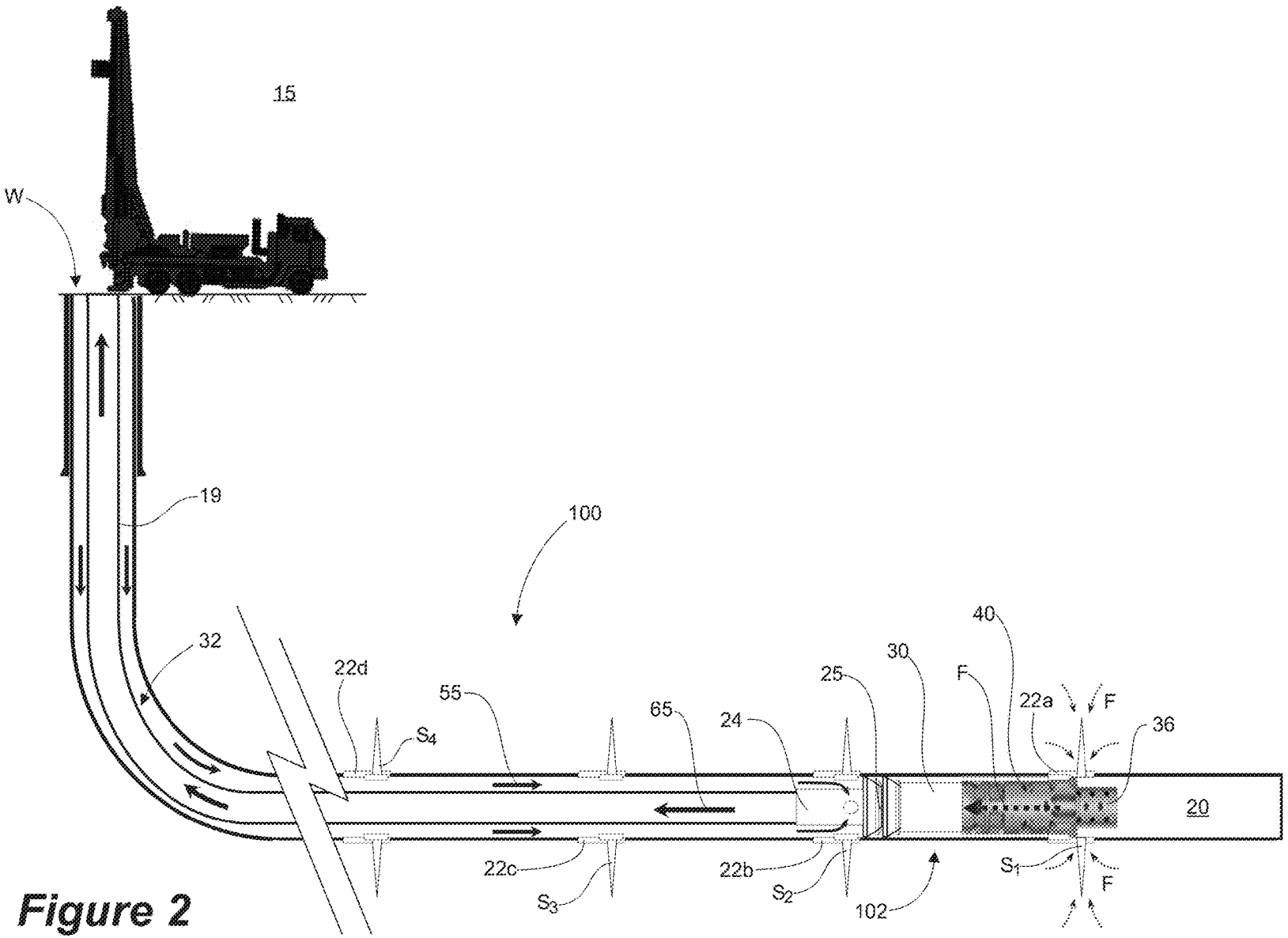
FIG. 2 is a schematic representation of a system for testing selective port(s) in the horizontal section of a well according to a first embodiment of the present disclosure.

FIG. 2 depicts one embodiment of the present disclosure for use with a well W, such as that shown in FIG. 1B, having closeable ports. In this sample embodiment, the horizontal section comprises ports $S_1$ to $S_4$ and corresponding sleeves 22*a* to 22*d*, respectively. While four ports are shown in FIG. 2, a person in the art can appreciate that the systems and methods described herein can be applied to a well with fewer or more ports. In FIG. 2, sleeves 22*b*, 22*c*, and 22*d* are in the closed position so that ports S2, S3, and S4, respectively, are closed. Sleeve 22*a* is shown in the open position such that port $S_1$ is open to allow reservoir fluid F to flow therethrough.

In FIG. 2, a system 100 comprises a bottomhole assembly 102 (BHA) having a jet pump 24, a pressure sealing device 25, and a shifting tool 40. In embodiments, the BHA may further comprise a production logging tool 30 (PLT). In further embodiments, the BHA may optionally comprise additional pressure recording subs and/or data recording devices. The BHA 102 may comprise one or more connected mandrels or tubulars with each mandrel or tubular connected to each other by threading or other known means and providing a bore therethrough. In some embodiments, the BHA 102 may comprise one or more mandrels that are at least partially nested within another mandrel.

The uphole end of the BHA is connectable to a downhole end of a jointed tubing string 19 by threaded connection or other known means. The jointed tubing string 19 comprises a plurality of individual tubings that are connected in series from end to end. A service rig 15 is used to run the jointed tubing string 19 into the wellbore by connecting and deploying one or more tubings of the jointed tubing string downhole at a time. Jointed tubing string 19, as deployed by service rig 15, is different from a coiled tubing, which is a continuous piece of tubing that can be spooled on a large reel. An annulus 32 is defined between the inner surface of the wellbore 20 and the outer surface of the jointed tubing string 19.

The jet pump 24 is a Venturi pump that creates suction when power fluid 55 is supplied thereto. The suction helps draw reservoir fluid F into the wellbore 20. A sample jet pump is disclosed in PCT Patent Publication No. WO/2013/003958.

The pressure sealing device 25 comprises a sealing element. In some embodiments, the sealing element is active-type seal, such as a packer, that sealing engages the inner surface of the wellbore when activated and disengages from the inner surface when deactivated. The active-type seal may be activated using any method known in the art, including compression activation, tension activation, hydraulic activation, or inflatable activation. For example, the pressure sealing device 25 may comprise a drag block that expands a set of slips when the BHA is moved uphole by pulling up the jointed tubing string. One example of a drag block is referred to as an auto-J mechanism. A specific movement pattern of the jointed tubing string 19 and the BHA (e.g. rotation and/or upward or downward movement) causes the slips to dig into the inner surface of the wellbore and then applies pressure on the packer to cause the packer to expand to sealingly engage the wellbore. The pressure sealing device 25 may also provide a feedthrough (not shown) for passing electrical lines therethrough, for example for powering electrical components therebelow.

In other embodiments, the sealing element is passive-type seal, such as a cup seal, that sealingly engages the wellbore without activation and is movable along the wellbore without deactivation. The passive-type seal is "set" (i.e., sealingly engages the inner surface of the wellbore) when it is stationary relative to the wellbore and is "unset" when a force is applied to the jointed tubing string 19 that is sufficient to move the passive-type seal uphole or downhole within the wellbore.

Shifting tool 40 is for opening and closing the ports in the wellbore. In embodiments where sleeves 22*a* . . . 22*d* are used to control fluid flow through ports S1 . . . S4, shifting tool 40 is configured to engage each sleeve to open and close same. To open and/or close each sleeve 22*a* . . . 22*d*, the shifting tool 40 may interact with each sleeve mechanical, electrically, magnetically, or a combination thereof, or by other means known in the art.

The BHA 100 has an intake 36 for receiving reservoir fluids F to allow fluids to enter the BHA and flow through the PLT. The intake may be positioned at or near the downhole end of BHA, the shifting tool 40 (for example, as shown in FIG. 2), or the PLT 30. Depending on the location of the intake, the reservoir fluid may have to flow around one or more components of the BHA prior to entering the intake. In the sample embodiment shown in FIG. 2, the BHA is configured such that the shifting tool 40 is downhole from the PLT 30. As such, if the intake is situated at or near the downhole end of the PLT, then the reservoir fluid has to flow around the shifting tool 40 in order to enter the BHA via the intake.

The intake 36 is in fluid communication with the jet pump 24. When supplied with power fluid 55, the jet pump 24 generates suction to draw at least some reservoir fluid F into the BHA through the intake. The reservoir fluid F received by the BHA flows through the PLT. The PLT 30 is configured to measure various parameters such as gas, water, and oil flow rates, as well as pressure and temperature of the received fluids (also referred to as the "test fluids"). The PLT may comprise one or more of the following sensing equipment: a telemetry package, a gamma-ray detector, a casing-collar locator, a temperature probe, a fluid-capacitance sensor, a fluid-conductivity sensor, an optical sensor, a pressure probe, an optical spectroscopy sensor, a sensor for measuring ultrasonic speed within a fluid, a magnetic resonance imaging sensor package, a radioactive density measurement sensor, a fluid-resistivity sensor, a sensor for measuring dielectric properties of a fluid, a tuning-fork vibration resonance sensor for measuring the density and viscosity of a fluid. The PLT can perform one or more testing operations to capture the necessary data. In some embodiments, the fluid-capacitance sensor and/or the conductivity sensor may be used to identify the fluid types (e.g. water, oil, or gas) within the test fluid. Further, the conductivity sensor may be used to determine the source of any detected water, for example if the detected water is reservoir water, fracking water, or wellbore water. The test fluid may be a mixture of bubbles of oil, water, or gas and the conductivity sensor may also count the length and duration of the bubbles. The optical sensor can be used to determine if the test fluid is a liquid or a gas and to count the number and size of any bubbles present in the test fluid. The casing collar locator and gamma-ray detector may be used to determine the position of the BHA 102 along the wellbore. The pressure and temperature sensors may be used for drawdown and buildup analysis. The sensing equipment within the PLT 30 is assembled, tested, calibrated, or otherwise prepared at surface for travelling downhole into wellbore 20.

In some embodiments, the components of the BHA are battery-operated so that there is no need to supply power to the BHA from surface.

The measurements collected by the PLT 30 can be recorded by a memory in the PLT and/or transmitted to surface by wireless data transmission (e.g. electromagnetic data transmission, radio transmission, etc.), wireline transmission, mud pulse data transmission, or other telemetry known in the art.

In operation, the service rig 15 runs jointed tubing string 19, already with the BHA connected to its downhole end, into the wellbore 20 to total depth or as close total depth as possible. Along the way, the shifting tool 40 engages and closes each sleeve 22*d* . . . 22*b* until the BHA is just above the lowermost sleeve 22*a*. The shifting tool 40 does not engage the lowermost sleeve 22*a* so the lowermost port $S_1$ remains open. With the BHA positioned above the lowermost port $S_1$, the pressure sealing device 25 engages the inner surface of the wellbore, with or without activation, depending on the type of sealing element in the pressure sealing device.

Next, as shown in the illustrated embodiment in FIG. 2, power fluid 55 is pumped down the annulus 32 to start circulation of the jet pump and any return fluid will flow back up to surface through the axial extending inner bore of the jointed tubing string 19. In an alternative embodiment, power fluid may be pumped down the inner bore of the jointed tubing string 19 and any return fluid will flow back up to surface through the annulus 32. When power fluid is supplied to the jet pump 24, the jet pump operates to draw reservoir fluid F from the formation into the wellbore 20 via the open lowermost port $S_1$. Once inside the wellbore, the reservoir fluid F is drawn into the PLT through the intake 36. As the reservoir fluid F flows through the PLT, the PLT measures the fluid flow rate, gas flow rate, pressure, and/or temperature of the reservoir fluid in real-time. The PLT can store the collected measurement data in its memory and/or send the data up to surface using any of the data transmission methods described above. The data collection performed by the PLT is also referred to herein as "testing" or "sampling".

After exiting the PLT 30, the reservoir fluid F combines with the jet pump power fluid 55 to form a return fluid 65. The return fluid 65 leaves the jet pump and is transported to surface through the jointed tubing string 19, or alternatively through the annulus 32 if the power fluid 55 is supplied by the jointed tubing string 19.

The testing is performed for a period of time sufficient to properly record characteristic inflow, pressure, and temperature data using the system 100. The appropriate time period for performing the testing varies depending on the particular reservoir. Once the data is collected with respect to the lowermost port $S_1$, the pressure sealing device 25 is unset and the shifting tool 40 is used to shift sleeve 22*a* to the closed position, thereby closing port S1. The BHA 102 is then moved uphole by pulling up on jointed tubing string 19 to the next port S2. Once the shifting tool 40 shifts the sleeve 22*b* to the open position thereby opening port $S_2$, sampling of the reservoir fluid through port $S_2$ be carried out using the process described above with reference to port $S_1$.

While the above process describes testing the plurality of ports in the horizontal section in sequential manner (i.e. downhole to uphole), a person in the art can appreciate that the testing does not have to be performed sequentially or performed on all the ports. In other words, the system 100 can be used to selectively test the reservoir fluids through a specific port(s). For example, the well operator may opt to omit one or more ports from testing. In another example, two or more ports may be sampled at the same time in a single testing session. In yet another example, the testing may be performed in an uphole to downhole direction, e.g. starting with the uppermost port and moving downhole in a subsequent testing session. Alternatively, the testing sessions may be performed randomly, starting with any one of the ports and testing any of the other ports in a subsequent testing session.

From the collected data, the well operator can then decide which sleeves to open and which sleeves to shut to help maximize the production of oil and/or gas from the reservoir. Further, the well operator can use the collected data to decide whether to modify the injection control device operation to control water break-through in the producing well(s).

In an alternative embodiment, instead of using the PLT to perform the testing downhole, the transported reservoir fluid can be tested at surface using flow testing equipment. In this embodiment, the system may comprise downhole gauges to record to flowing bottomhole pressures and temperatures of the reservoir fluid in the wellbore and the collected pressure and temperature data can subsequently be correlated with the flow data determined at surface for further analysis or evaluation.

Figure 3:
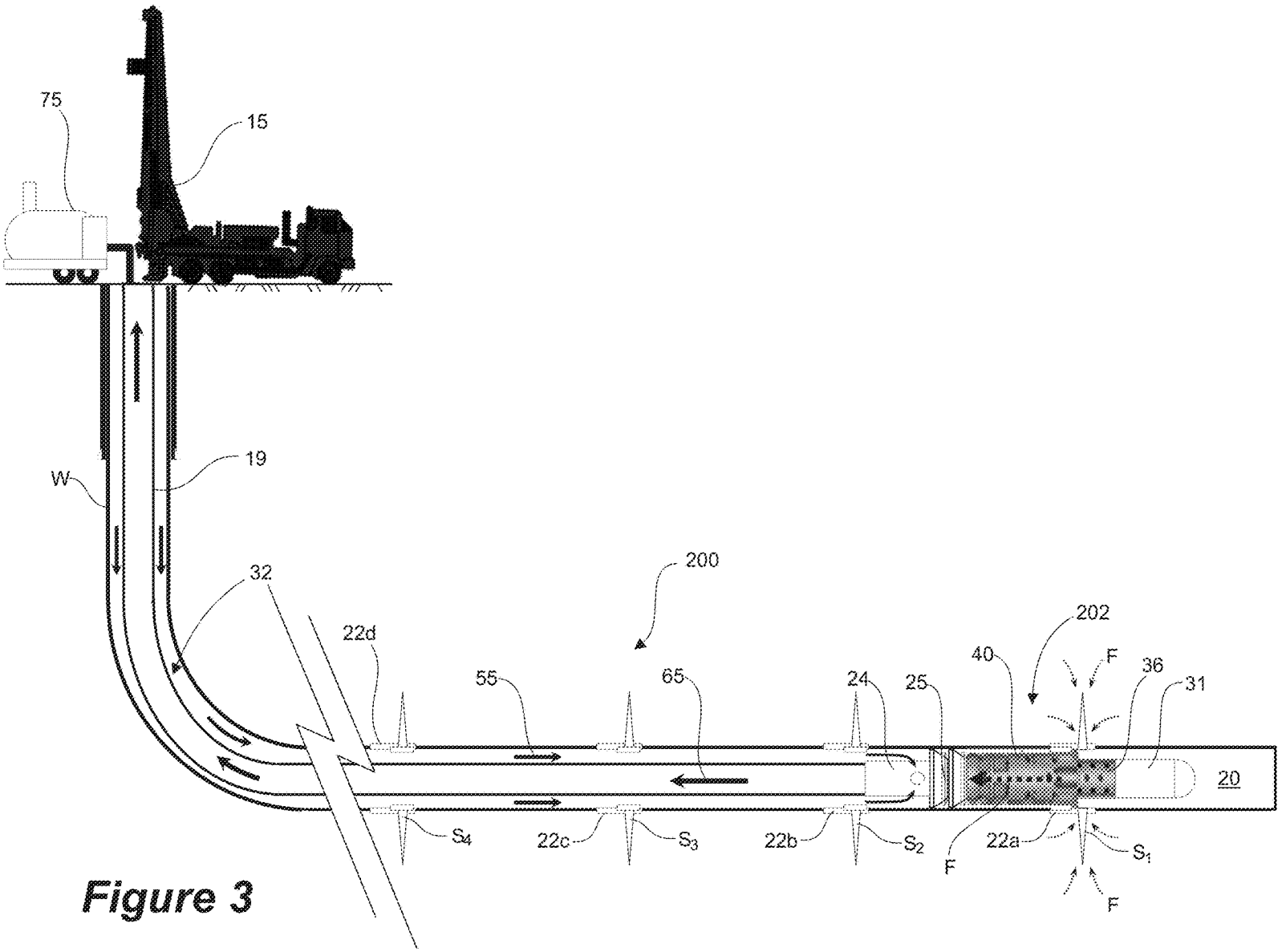
FIG. 3 is a schematic representation of a system for testing selective port(s) in the horizontal section of a well according to a second embodiment of the present disclosure.

FIG. 3 shows a system 200 according to a second embodiment of the present disclosure. System 200 comprises the same components as system 100 as described above with respect to FIG. 2, except the BHA 202 includes a downhole pressure and temperature recorder 31 instead of the PLT. In this embodiment, the intake 36 may be positioned downhole from the shifting tool 40 (as shown in FIG. 3) or immediately downhole from the jet pump 24. The recorder 31 is configured to collect time-referenced pressure and temperature data of the reservoir fluid F in the wellbore 20, while surface flow testing equipment 75 is used to measure and record flow rates of the reservoir fluid that has been transported to surface. System 200 operates in the manner as described above with respect to system 100.

Figure 4A:
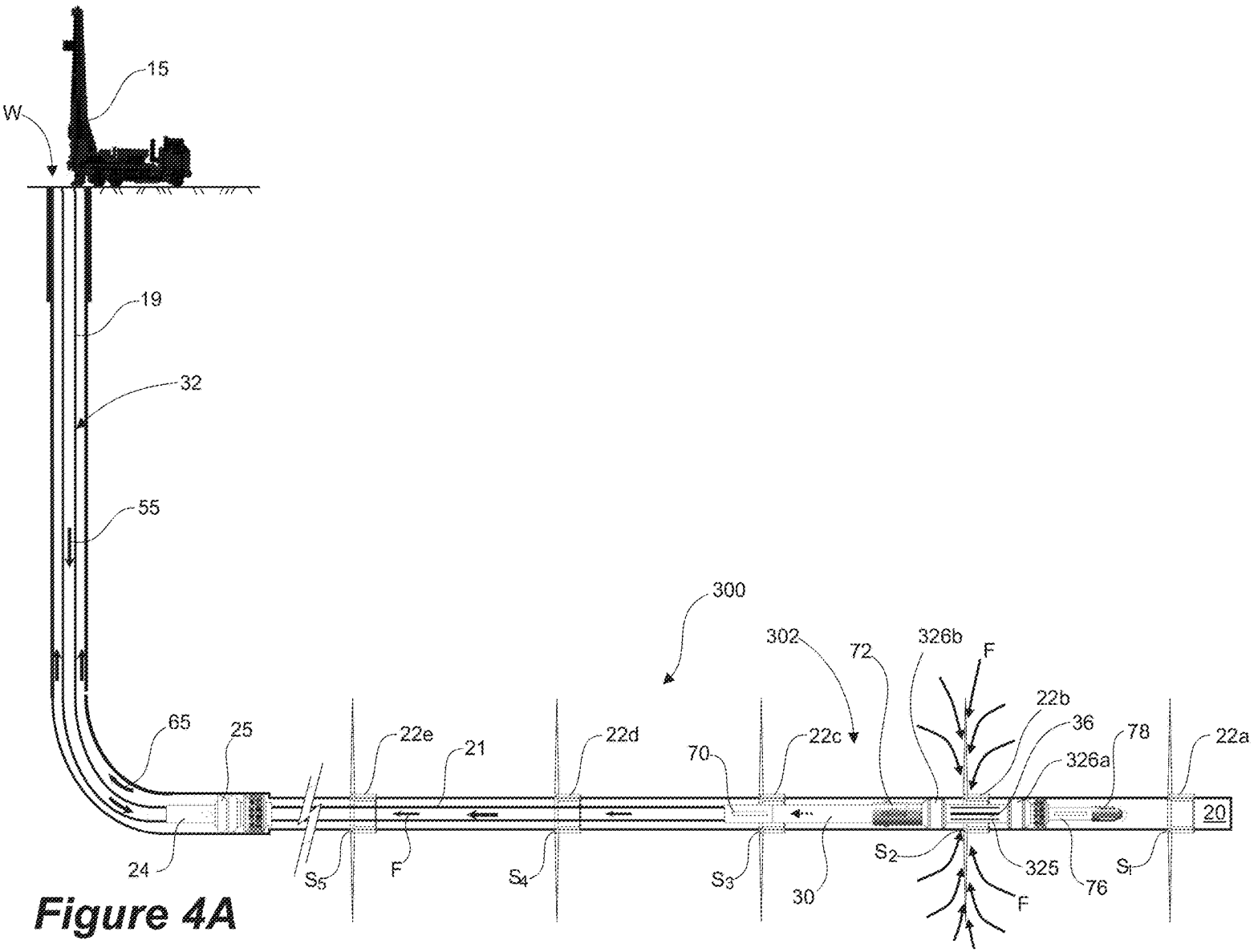
FIG. 4A is a schematic representation of a system for testing selective fixed port(s) in the horizontal section of a well according to a third embodiment of the present disclosure.
Figure 4B:
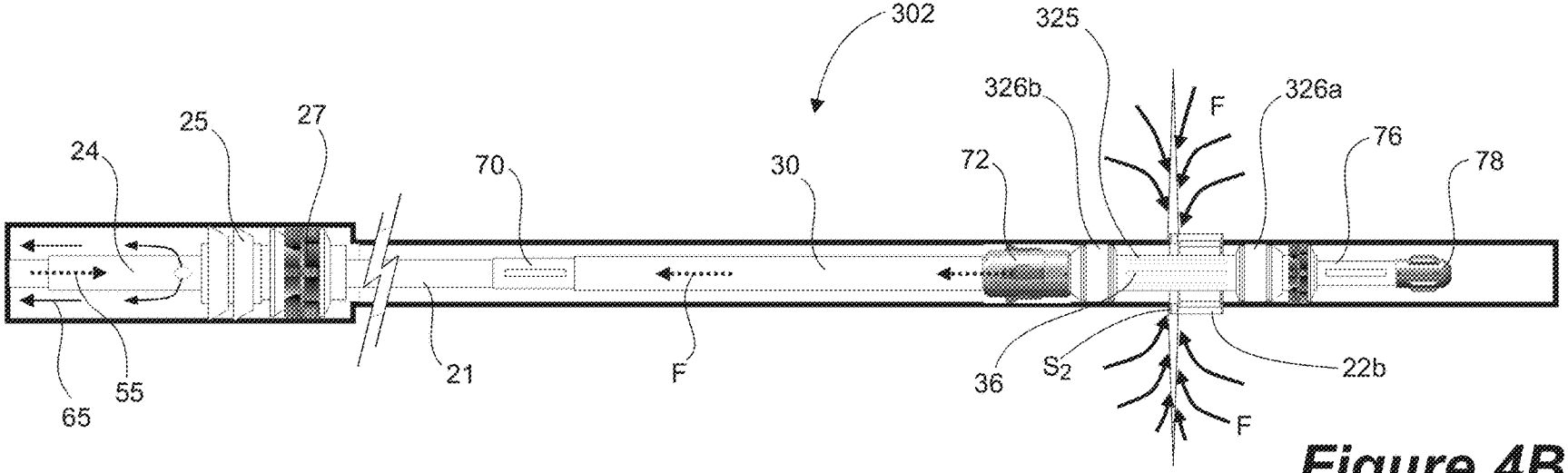
FIG. 4B is a schematic representation of one embodiment of a bottomhole assembly usable in the system shown in FIG. 4A.

FIG. 4A shows a system 300 according to a third embodiment of the present disclosure. System 300 comprises a BHA 302 that is connectable to a downhole end of the jointed tubing string 19. The jointed tubing string 19 is deployable downhole using the service rig 15 as described above. In a sample embodiment as shown in FIG. 4B, the BHA 302 comprises, from a first end to a second end: a jet pump 24, a pressure sealing device 25, a PLT 30, a casing collar locator 72, a straddle isolation device 325, and a guide shoe 78. The pressure sealing device 25 is connected to the PLT 30 by an extension tubing 21 having an axially extending inner bore that allows fluid communication from one end to the other. The BHA 302 may optionally include an upper gauge sub 70 (which may be positioned between the tubing 21 and the PLT 30) and/or a lower gauge sub 76 (which may be positioned between the straddle isolation device 325 and the guide shoe 78). As a person of skill in the art would appreciate, the components of the BHA may be in a different order or arrangement that shown in the illustrated embodiment.

The jet pump 24 and pressure sealing device 25 are as described above. In the sample embodiment shown in FIG. 4B, the sealing element of the pressure sealing device 25 is a cup tool and the pressure sealing device 25 may further include an optional anchor 27. Alternatively, as shown in the sample embodiment in FIG. 4C, the sealing element of the pressure sealing device 25 is a service packer.

The PLT 30 is as described above. In a sample embodiment as shown in FIG. 4E, the PLT 30 may comprise a memory 320, a pressure and/or temperature sensor 322, an acoustic density sensor 324, a fluid capacitance sensor 327, and a continuous flow meter 328, which may or may not be in the same sequence as shown in FIG. 4E.

Figure 4C:
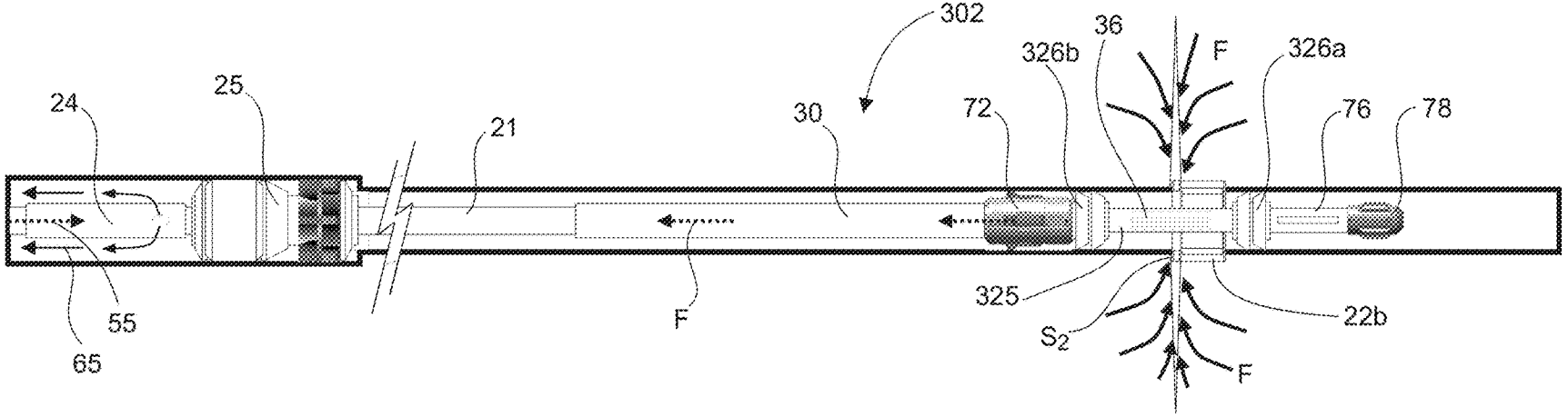
FIG. 4C is a schematic representation of another embodiment of a bottomhole assembly usable in the system shown in FIG. 4A.
Figure 4D:
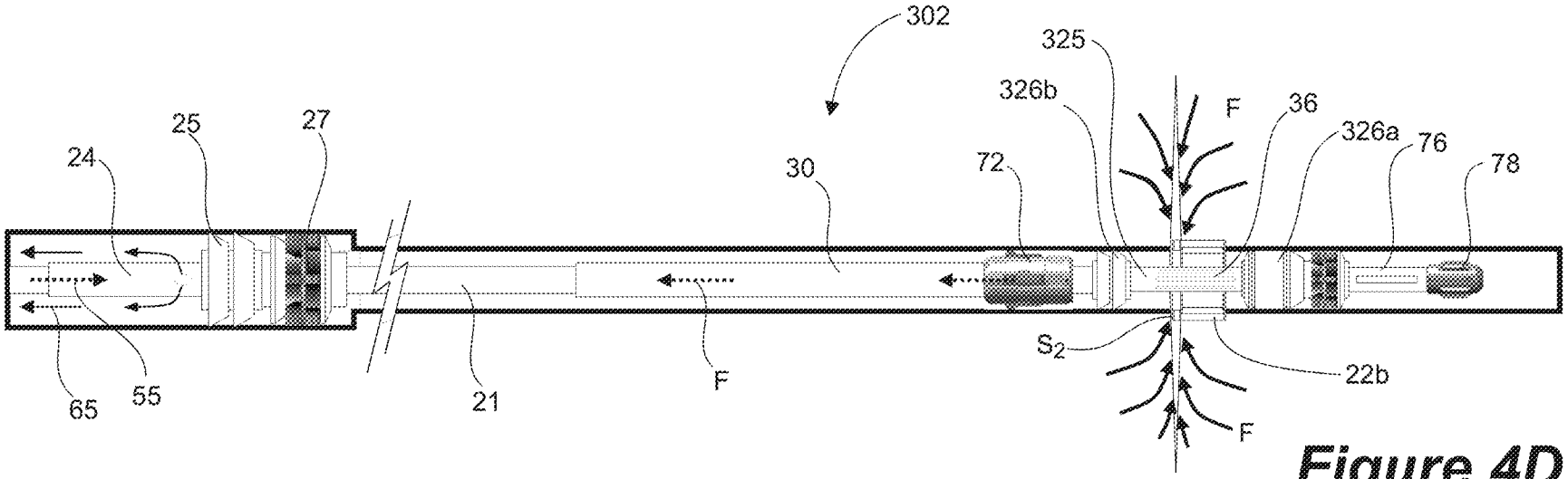
FIG. 4D is a schematic representation of yet another embodiment of a bottomhole assembly usable in the system shown in FIG. 4A.
Figure 4E:
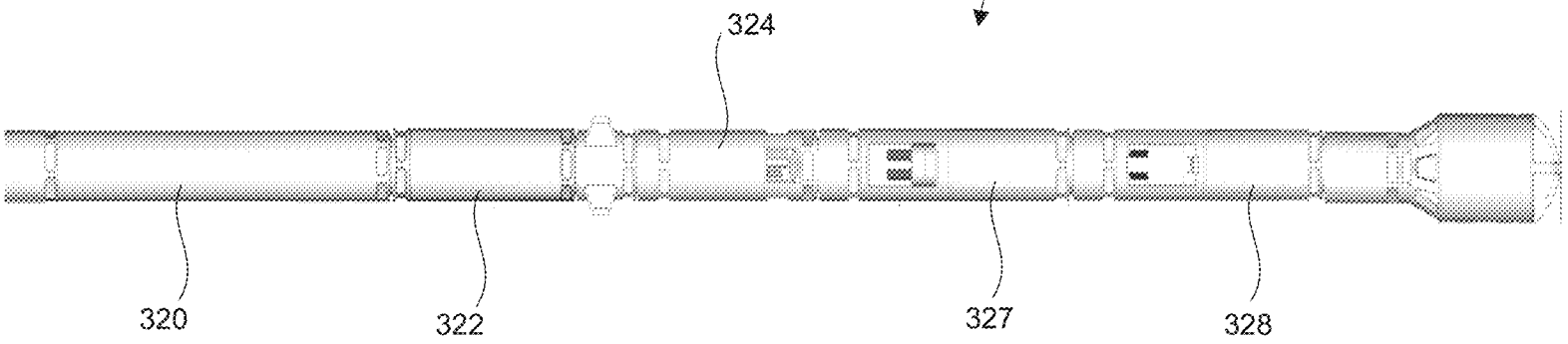
FIG. 4E is a detailed schematic representation of a production logging tool usable in the bottomhole assemblies shown in FIGS. 4B to 4D.

In some embodiments, with reference to FIGS. 4B to 4D, the straddle isolation device 325 comprises a lower sealing element **326*a* and an upper sealing element 326*b*. Each sealing element of device 325 may be an active-type seal (such as a packer, as shown for example in FIG. 4B) or a passive-type seal (such as a cup, as shown for example in FIG. 4C). Further, the upper sealing element 326*b* may or may not be the same as the lower sealing element 326*a*. In the sample embodiment shown in FIG. 4D, the upper sealing element 326*b* is a cup tool while the lower sealing element 326*a* is a service packer. The straddle isolation device 325 may further comprise an anchor. The straddle isolation device 325 also has an intake 36 positioned between the upper and lower sealing elements for receiving fluids therethrough. The intake is in fluid communication with the PLT 30 such that any fluid received by the straddle isolation device 325** can be transported to the PLT for analysis.

The casing collar locator 72 is used to determine the location of the BHA downhole to ensure accurate depth placement of the BHA.

The length of the extension tubing 21 is selected to ensure that the jet pump 24 is positioned at a sufficient vertical depth that it is able to adequately lift at the target production testing rates when in use. In some embodiments, production testing rates may range from 0 $m^3$/day to about 500 $m^3$/day. Extension tubing length and the resultant jet pump operating depth are factors that affect the efficiency of the system 300. For some wells, it may be necessary to test one or more ports of a first set of ports with a first length of extension tubing 21, then pull the BHA uphole to the pressure sealing device 25, add more length to the extension tubing 21 to provide a longer second length, and then run the BHA back downhole to test one or more of a second set of ports further downhole from the first set of ports. Of course, the reverse process may be implemented to test the second set of ports prior to testing the first set of ports.

The upper and lower gauge subs 70,76 are used to determine whether the straddle isolation device 325 is set properly. For example, when the system 300 is in operation, and if the straddle isolation device 325 is set properly, the pressure readings from both the upper and lower gauge subs 70,76 will be about the same, while the measurement taken by the PLT 30 will show a pressure draw-down. A discrepancy between the pressure readings from gauge subs 70,76 is an indication that the straddle isolation device 325 may not be set properly and/or there is a fluid leak somewhere in the wellbore.

The guide shoe 78 is a profiled end that allows the BHA to slide into the wellbore without getting caught on the liner hanger.

In operation, with reference to FIGS. 4A to 4D, the BHA 302 is attached to the downhole end of the jointed tubing string 19 and the jointed tubing string 19 is run into the wellbore by the service rig 15 until the straddle isolation device 325 reaches the port to be tested. The length of the extension tubing 21 is selected so that when the straddle isolation device 325 reaches the port to be tested, the jet pump 24 and pressure sealing device 25 are uphole from the uppermost port in the wellbore. The jet pump 24 and pressure sealing device 25 may be in the horizontal section or in the heel section of the well. In the illustrated embodiment, as shown in FIG. 4A, the horizontal section of the well to be tested has open ports $S_1$ to $S_5$. Each port may have a corresponding sleeve 22*a*, 22*b*, 22*c*, 22*d*, or 22*e* that is fixed in the open position. In the illustrated sample embodiment, the straddle isolation device 325 is positioned across port $S_2$, with the upper sealing element 326*b* uphole from the port $S_2$ and the lower sealing element 326*a* downhole from the port $S_2$, such that device 325 "straddles" the port $S_2$.

Once the straddle isolation device 325 is in the desired position (i.e. across the port of interest), the pressure sealing device 25 and the straddle isolation device 325 are set such that their sealing elements are activated (for active-type seals) or set (for passive-type seals) and their anchors, if included, engage the inner surface of wellbore 20. The upper and lower sealing elements 326*b*,326*a*, when sealingly engaged with the inner surface of the wellbore, help ensure that only the wellbore fluid adjacent to the intake can enter the BHA. After setting the pressure sealing device 25 and the straddle isolation device 325, power fluid 55 is pumped down from surface to the jet pump 24 via jointed tubing string 19 (alternatively, via annulus 32) to operate the jet pump 24, thereby generating a pressure drawdown downhole from the jet pump 24 induce fluid flow from the reservoir through the isolated port $S_2$ up to the jet pump, via the intake of the straddle isolation device 325, the PLT 30, the upper gauge sub 70 (if included), and the inner bore of tubing 21, respectively. While passing through the PLT 30, various key parameters of the test fluid are measured by the PLT. The PLT 30 may transmit the measurement data in real-time to surface or record the data in its memory, as described above. After exiting PLT 30, the test fluid flows through tubing 21 to bypass any other open port(s) between the straddle isolation device 325 and the jet pump 24. From tubing 21, the test fluid reaches the jet pump 24 and combines with the power fluid to form a return fluid 65. The return fluid 65 then leaves the jet pump and is transported to surface through the jointed tubing string 19, or alternatively through the annulus 32 if the power fluid 55 is supplied inside the jointed tubing string 19.

In alternative or additional embodiment, the system 300 may include surface testing equipment for determining the flow rates and fluid properties of the return fluid at surface. In this embodiment, system 300 may collect pressure data downhole using a pressure gauge in the PLT 30 and subsequently correlate the downhole pressure data with the measurements obtained at surface.

Once enough data is collected from the test fluid received from port $S_2$, the pressure sealing device 25 and the straddle isolation device 325 are unset such that their sealing elements are deactivated or unset, and the BHA is then moved to the next port of interest, which may be uphole or downhole from port $S_2$, by either pulling or pushing the jointed tubing string 19. When the straddle isolation device 325 reaches the port of interest, the above described process is repeated to sample reservoir fluid from that port.

After the testing is done, the well operator may find that one or more ports are producing too much water such that they adversely affect the overall oil and/or gas production rate of the well. In such a case, it may be desirable to perform water shut-off treatments on the one or more high water producing ports. In some embodiments, the BHA may be run back into the wellbore to isolate one or more ports with a high water production rate, i.e., by positioning the straddle isolation device 325 to straddle the port(s), to perform water shut-off treatments on same, for example by injecting chemicals or water blocking agents, or other methods known in the art.

Figure 5:
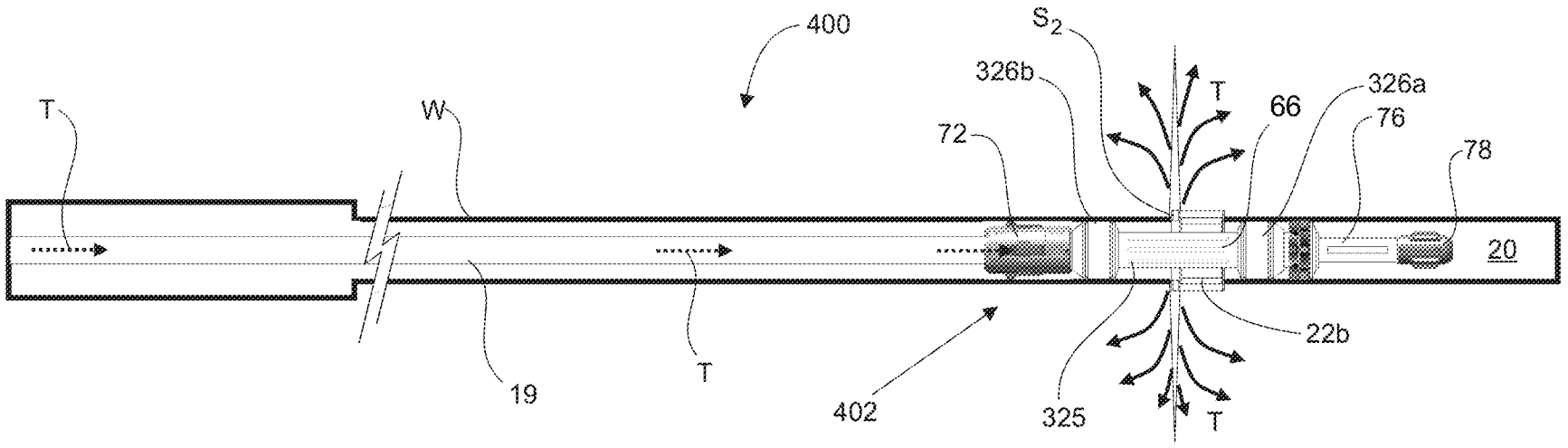
FIG. 5 is a schematic representation of a bottomhole assembly for delivering fluid to a port.

FIG. 5 shows a sample system 400 for performing water shut-off treatments. System 400 comprises a jointed tubing string 19 and a BHA 402 connected to a downhole end thereof, the BHA comprising a casing collar locator 72, a straddle isolation device 325, an optional lower gauge sub 76, and a guide shoe 78. The jointed tubing string 19 is deployable downhole by a service rig at surface (not shown). The jointed tubing string 19, the locator 72, the straddle isolation device 325, the lower gauge sub 76, and the guide shoe 78 are all as described above with respect to system 300. In this embodiment, the straddle isolation device 325 further comprises an outlet 66 that is in fluid communication with the inner bore of the jointed tubing string to allow fluid flowing from the jointed tubing string to the device 325 to exit into the wellbore 20.

The outlet 66 is positioned between the upper and lower sealing elements 326*b*,326*a* and the outlet may or may not be the same as the intake.

In operation, the jointed tubing string 19 with the BHA 402 connected thereto is run into the wellbore until the straddle isolation device reaches and straddles the port $S_2$ to be shut off. The straddle isolation device 325 is then set to activate or set its sealing elements 326*a*,326*b*. After the straddle isolation device 325 is set, treatment fluid T is pumped downhole via the inner bore of the jointed tubing string 19 and exits into the wellbore through the outlet 66 of the straddle isolation device 325. From the wellbore, the treatment fluid T flows into the formation via the open port $S_2$. The treatment fluid may comprise various chemicals and/or water blocking agents as known to those in the art.

When enough treatment fluid T has been delivered to the port $S_2$, the pumping of the treatment fluid ceases and then the straddle isolation device 325 is unset by deactivating or unsetting its sealing elements 326*a*,326*b*. Once the straddle isolation device 325 has been unset, the BHA 402 can be moved uphole or downhole to repeat the above described water shut-off process on another port.

In an alternative embodiment, if the sleeves 22*a*, 22*b*, 22*c*, 22*d*, and 22*e* of the well are closeable instead of fixed, the BHA may further comprise a shifting tool, such as shifting tool 40 as described above with respect to system 100, for selectively closing one or more sleeves 22*a*, 22*b*, 22*c*, 22*d*, 22*e* in order to shut off flow from one or more ports.

Figure 6:
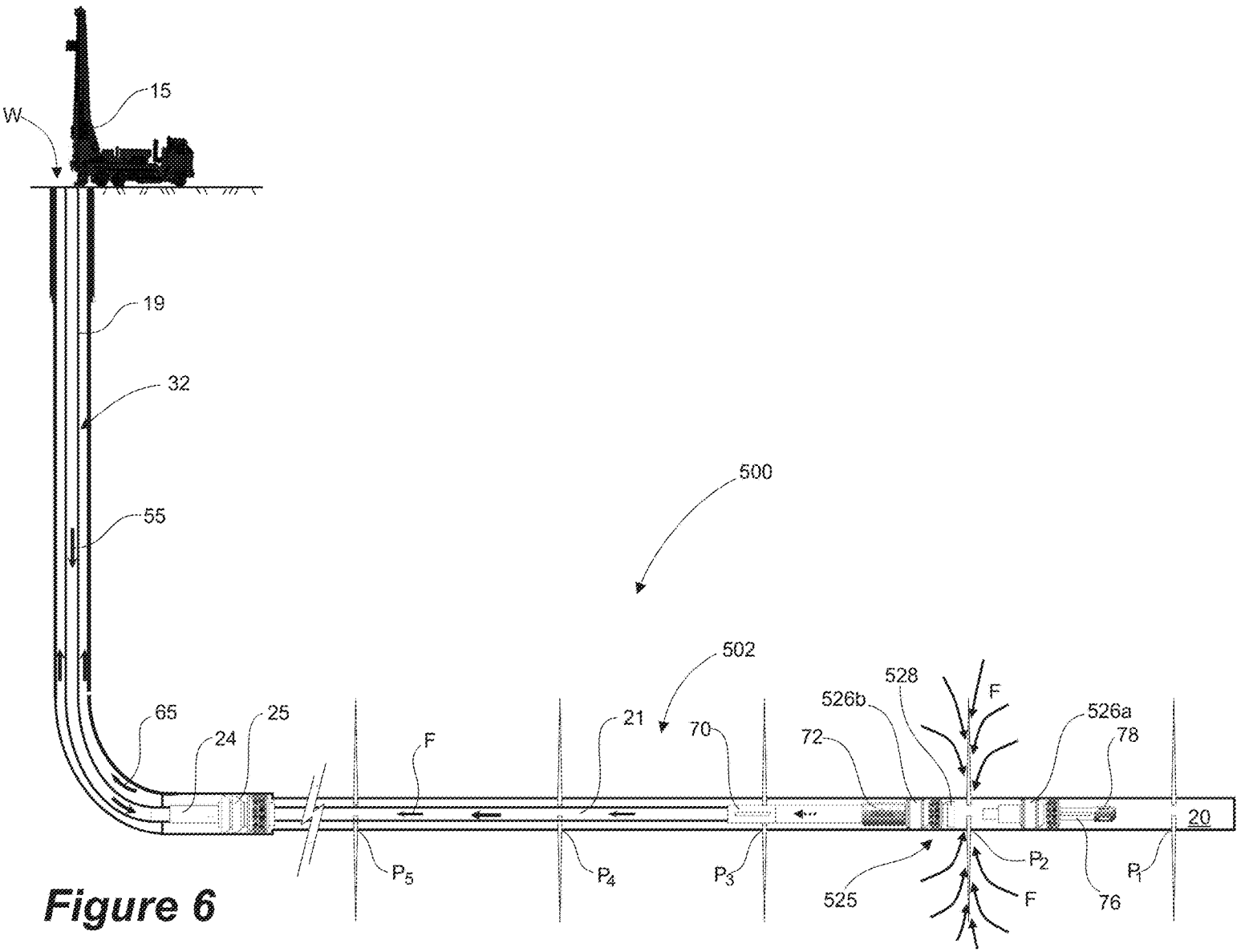
FIG. 6 is a schematic representation of a system for testing selective port(s) in the horizontal section of a well according to a fourth embodiment of the present disclosure, wherein the system comprises a detachable/re-attachable lower isolation device.

FIG. 6 shows a system 500 according to a fourth embodiment of the present disclosure. System 500 comprises a BHA 502 that is connectable to a downhole end of the jointed tubing string 19. The worksting 19 is deployable downhole using the service rig 15 as described above. The BHA 502 comprises the same components as system 300 describe above, except BHA 502 comprises a pressure isolation device 525 instead of the straddle isolation device 325.

The pressure isolation device 525 comprises an upper isolation device 526*b* and a lower isolation device 526*a*. The pressure isolation device 525 further comprises an on/off tool 528, which may be positioned between the upper and lower isolation devices 526*b*,526*a*. The upper and lower isolation devices 526*b*,526*a* each include a sealing element which may be a cup-type seal or a packer-type seal, as described above, and the sealing elements of the upper and lower isolation devices 526*b*,526*a* may or may not be the same as one another. The pressure isolation device 525 further comprises an intake positioned at or near the upper isolation device 526*b* or the on/off tool 528 for receiving fluids therethrough. The intake is in fluid communication with the PLT 30 such that any fluid received by the pressure isolation device 525 can be transported to the PLT for analysis.

The pressure isolation device 525 is configured such that the lower isolation device 526*a* is selectively detachable and re-attachable to the upper isolation device 526*b* by unlocking and locking (or activating and re-activating) the on/off tool, respectively. In the "lock" position, the on/off tool connects the lower isolation device 526*a* to the upper isolation device 526*b* and in the "unlock" position the on/off tool disconnects the lower isolation device 526*a* from the upper isolation device 526*b*. In a sample embodiment, the on/off tool is a "J" latch connect/disconnect tool comprising a J-Slot that engages automatically and releases with a ¼ turn left-hand rotation. The on/off tool can be returned to the lock position by pushing the upper and lower isolation devices 526*b*,526*a* together to engage the "J" latch, thereby reconnecting the upper and lower isolation devices 526*b*, 526*a*. As one skilled in the art can appreciate, other connect/disconnect mechanisms can be used in the on/off tool to attach and detach upper and lower isolation devices 526*b*, 526*a*.

The jet pump 25, pressure sealing device 25, extension tubing 21, PLT 30, casing collar locator 72, upper isolation device 526*b*, and on/off tool 528, and optionally anchor 27 and upper gauge sub 70, of the BHA 502 define an upper portion of the BHA 502. The lower isolation device 526*a* and the guide shoe 78, and optionally lower gauge sub 76, of the BHA 502 define a lower portion of the BHA 502.

In the illustrated embodiment, as shown in FIG. 6, the horizontal section of the well to be tested has fixed open ports $P_1$ to $P_5$. Each port may have a corresponding sleeve (not shown) that is fixed in the open position.

Figure 7A:
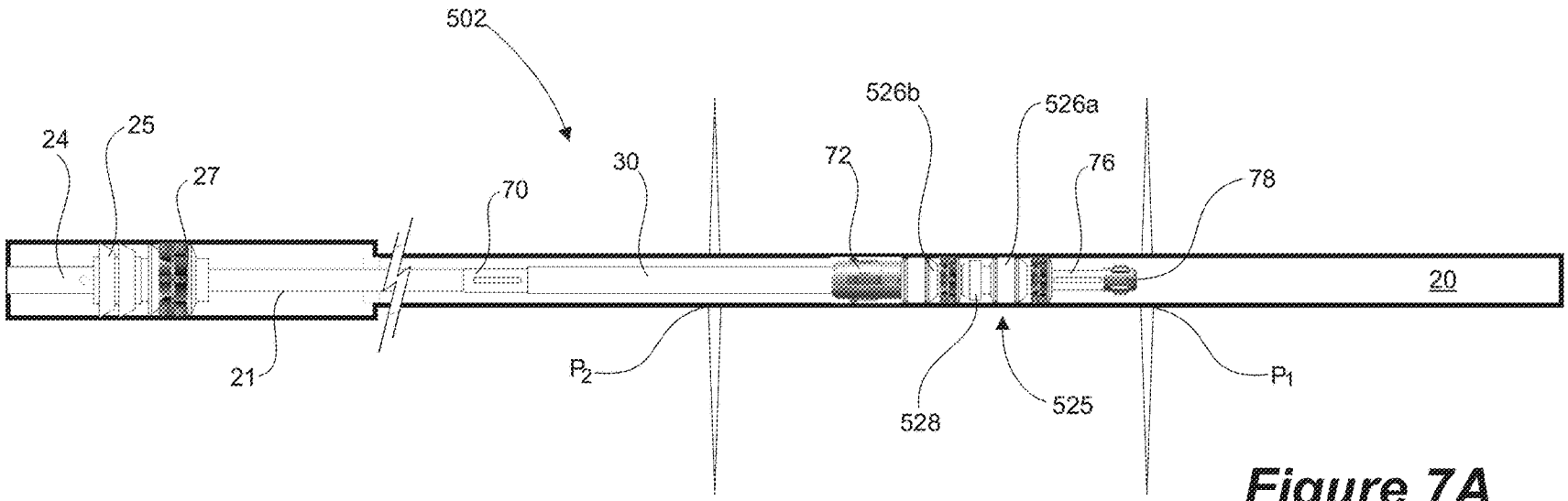
FIG. 7A is a schematic representation of the system of FIG. 6, depicted in the process of running its bottomhole assembly into the horizontal section.
Figure 7B:
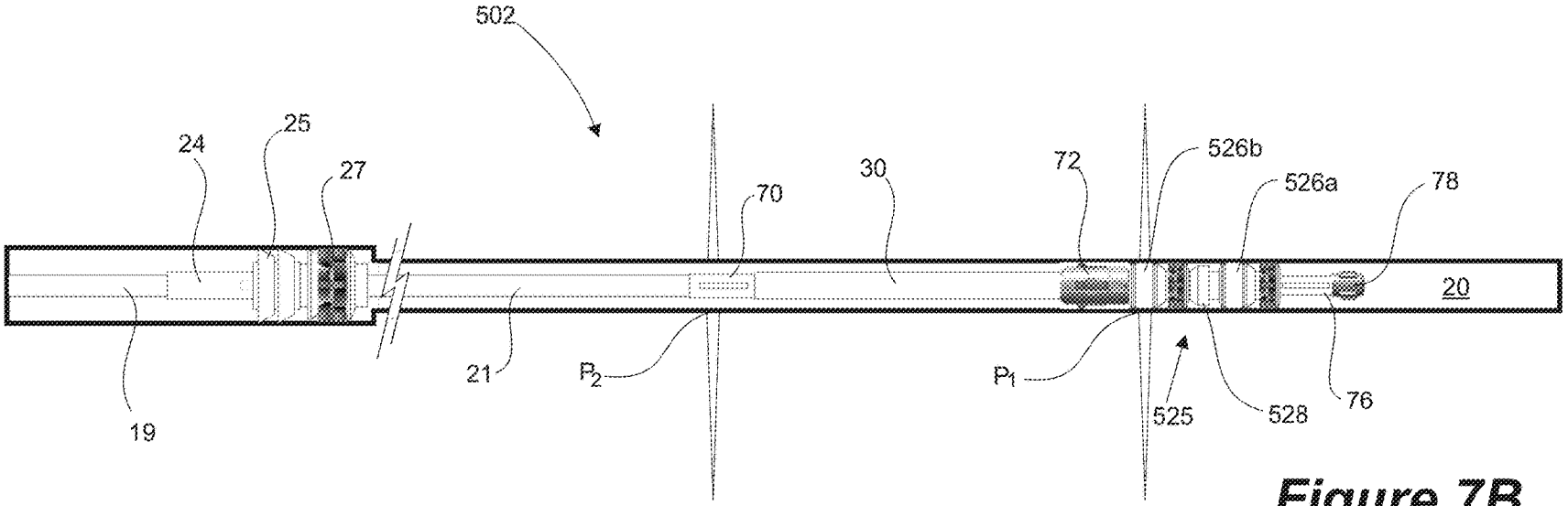
FIG. 7B is a schematic representation of the system of FIG. 6, depicted in the process of setting the lower isolation device.
Figure 7C:
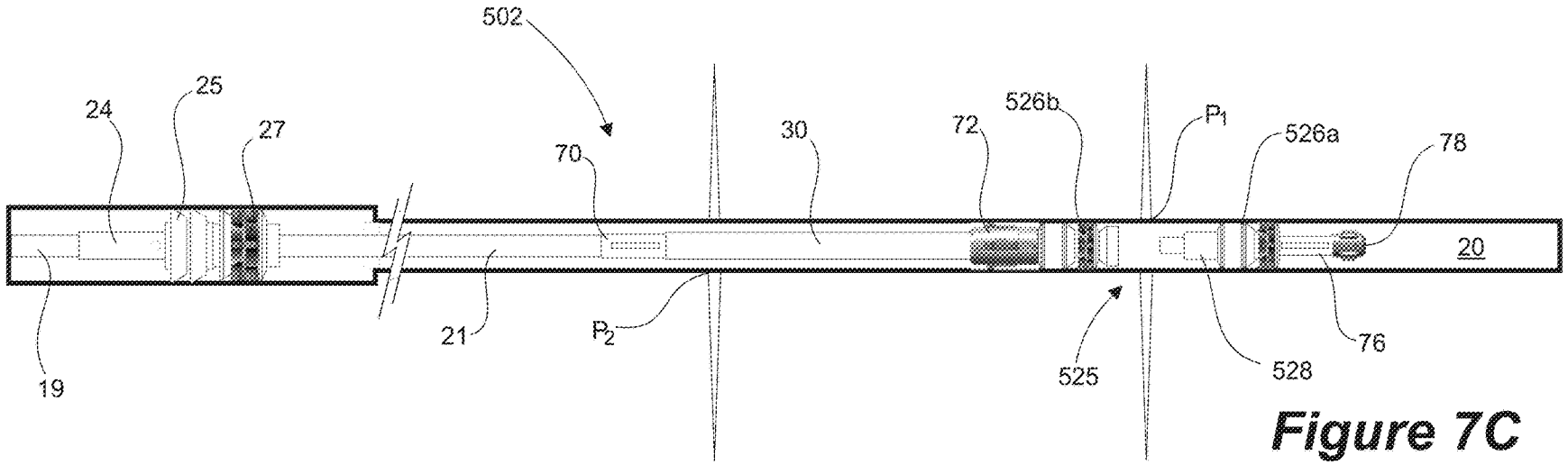
FIG. 7C is a schematic representation of the system of FIG. 6, depicted in the process of releasing the lower isolation device thereof and pulling up an upper portion thereof.
Figure 7D:
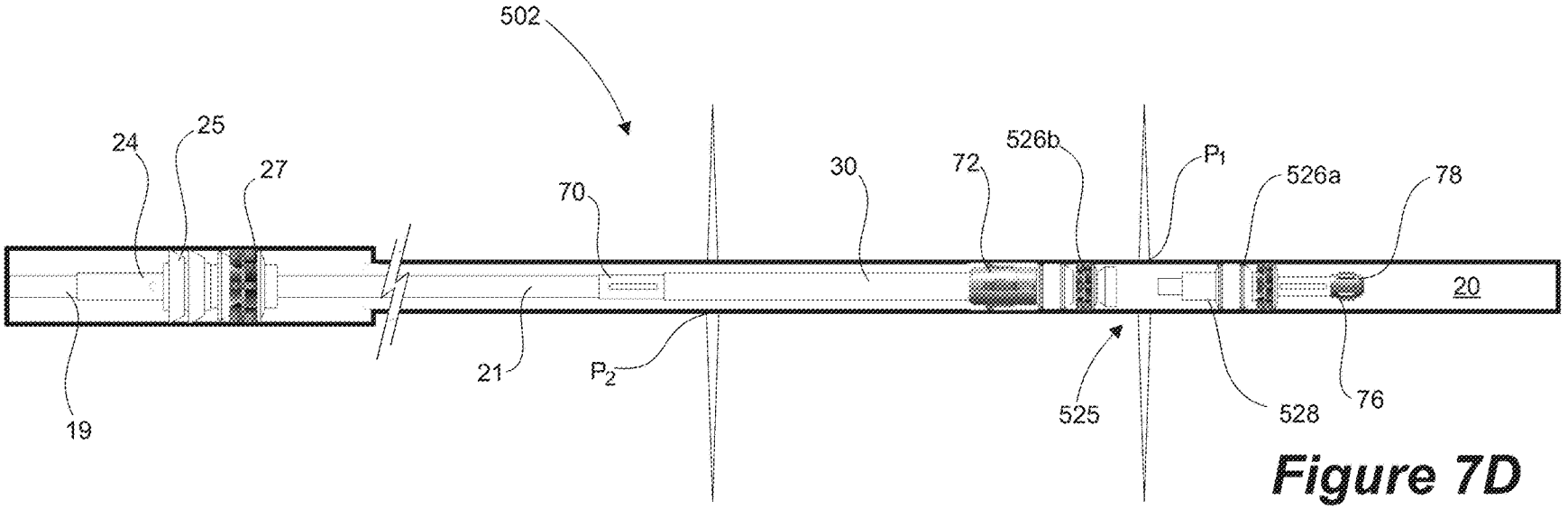
FIG. 7D is a schematic representation of the system of FIG. 6, depicted in the process of setting a pressure sealing device and an upper isolation device thereof.

In operation, with reference to FIGS. 7A to 7G, the BHA 502 is attached to the downhole end of the jointed tubing string 19 and the jointed tubing string 19 is run into the wellbore by the service rig 15 until the lower isolation device 526*a* of the pressure isolation device 525 is below (i.e. downhole from) the port $P_1$ to be tested (see FIG. 7B).

Once the lower isolation device 526*a* is in the desired position (i.e. downhole from the port of interest), the lower isolation device 526*a* is set such that its sealing element is activated or set, thereby sealingly engaging the inner surface of the wellbore below the port $P_1$ (see FIG. 7B). After the lower isolation device 526*a* is set, the on/off tool 528 is unlocked or activated to detach the upper portion of the BHA 502 from the lower portion thereof. The jointed tubing string 19 is then pulled uphole to move the upper portion of the BHA 502 above the port $P_1$, more particularly to place the upper isolation device 526*b* above the port $P_1$ (see FIG. 7C). Thereafter, the pressure sealing device 25 and the upper isolation device 526*b* are set and their anchors, if included, engage the inner surface of wellbore 20 (see FIG. 7D). The upper and lower isolation devices 526*b*,526*a*, when set, isolate the port $P_1$ to help ensure that only the reservoir fluid flowing from the port $P_1$ enters the BHA via the intake.

In some embodiments, the length of the extension tubing 21 is selected so that when the upper isolation device 526*b* is above the port(s) to be tested, the jet pump 24 and pressure sealing device 25 are uphole from the uppermost port in the wellbore. The jet pump 24 and pressure sealing device 25 may be in the horizontal section or in the heel section of the well.

Figure 7E:
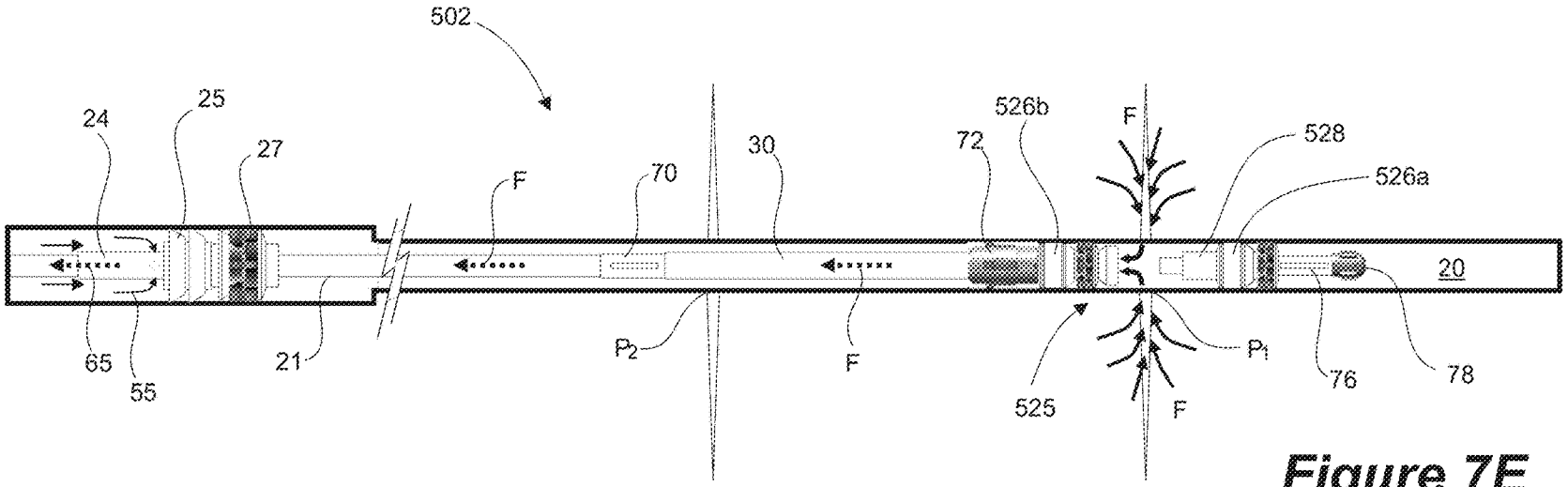
FIG. 7E is a schematic representation of the system of FIG. 6, depicted in the process of drawing wellbore fluid from a port in the horizontal section.

With reference to FIGS. 6 and 7E, after setting the pressure sealing device 25 and the upper isolation device 526*b*, power fluid 55 is pumped down from surface to the jet pump 24 via jointed tubing string 19 (alternatively, via annulus 32) to operate the jet pump 24, thereby generating a pressure drawdown downhole from the jet pump 24 induce fluid flow from the reservoir through the isolated port $P_1$ up to the jet pump, via the intake of the pressure isolation device 525, the PLT 30, the upper gauge sub 70 (if included), and the inner bore of tubing 21, respectively. While passing through the PLT 30, various key parameters of the test fluid are measured by the PLT. The PLT 30 may transmit the measurement data in real-time to surface or record the data in its memory, as described above. After exiting PLT 30, the test fluid flows through tubing 21 to bypass any other open port(s) between the upper isolation device 526*b* and the jet pump 24. From tubing 21, the test fluid reaches the jet pump 24 and combines with the power fluid to form a return fluid 65. The return fluid 65 then leaves the jet pump and is transported to surface through the jointed tubing string 19, or alternatively through the annulus 32 if the power fluid 55 is supplied inside the jointed tubing string 19.

In alternative or additional embodiment, the system 500 may include surface testing equipment for determining the flow rates and fluid properties of the return fluid 65 at surface. In this embodiment, system 500 may collect pressure data downhole and subsequently correlate the downhole pressure data with the measurements obtained at surface.

Figure 7F:
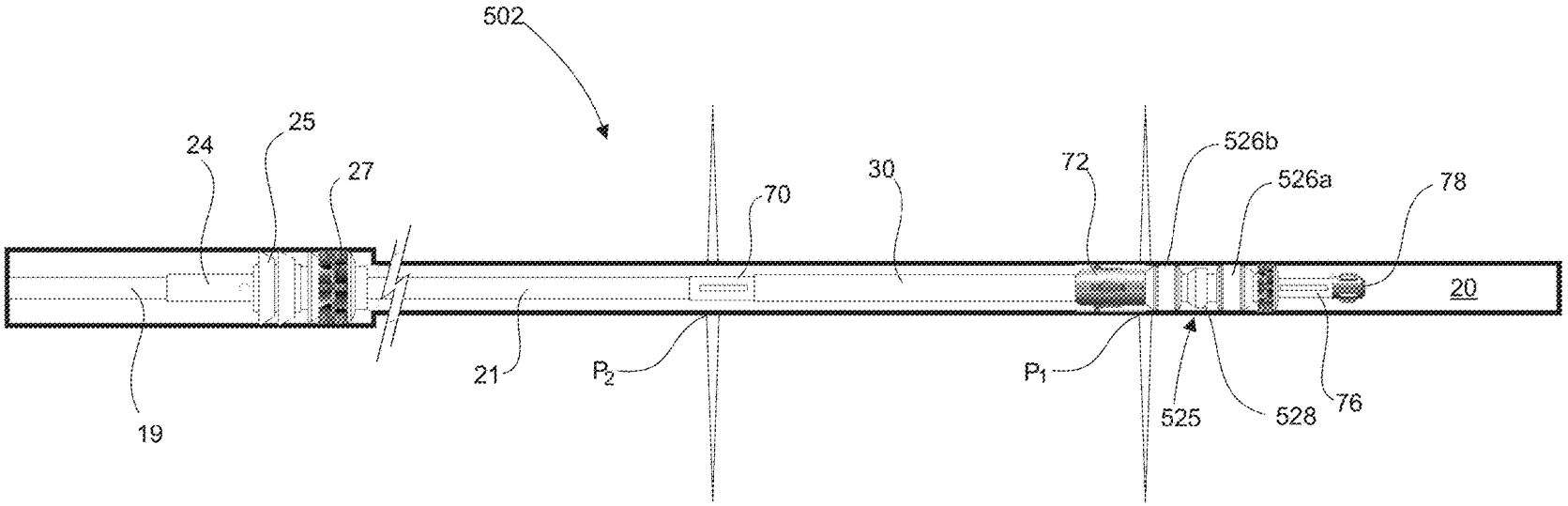
FIG. 7F is a schematic representation of the system of FIG. 6, depicted in the process of retrieving the lower isolation device.

Once enough data is collected from the test fluid received from port $P_1$, the pressure sealing device 25 and the upper isolation device 526*b* are unset and the jointed tubing string 19 is pushed downhole to move the upper portion of the BHA 502 downhole to retrieve the lower portion of the BHA 502 using the on/off tool (see FIG. 7F). The on/off tool is re-activated (or locked) when the upper isolation device 526*b* comes into contact with the lower isolation device 526*a*, thereby reconnecting the upper portion with the lower portion of the BHA 502.

Figure 7G:
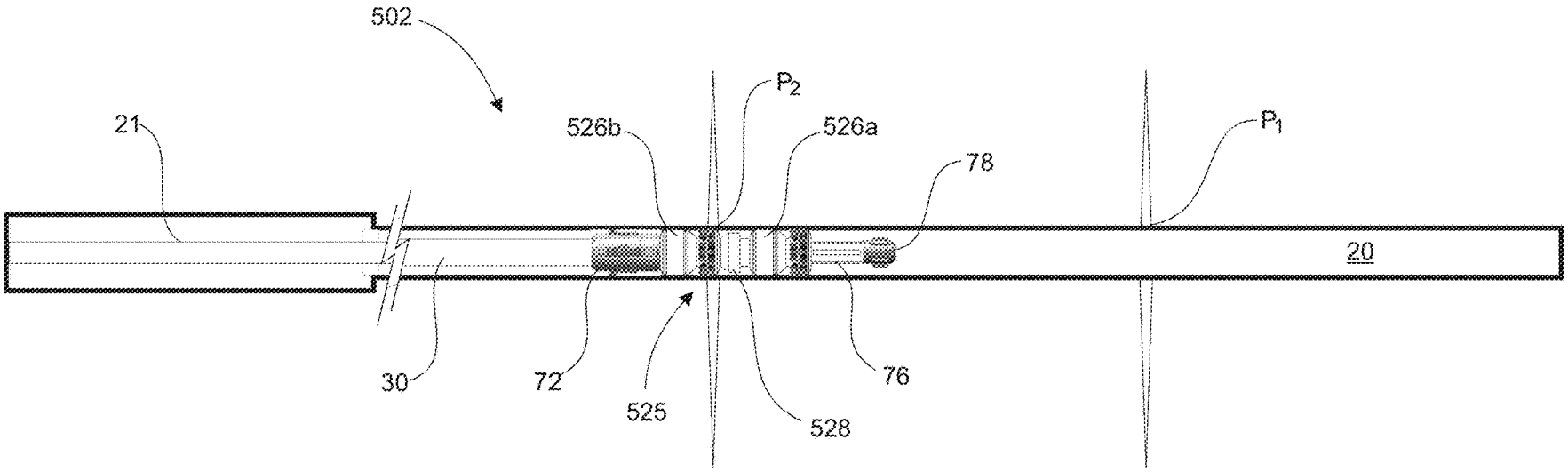
FIG. 7G is a schematic representation of the system of FIG. 6, depicted in the process of pulling up its bottomhole assembly for testing another port.

After the upper portion and the lower portion of the BHA 502 are reconnected, the BHA 502 can be moved to the next port(s) of interest, which may be uphole or downhole from port $P_1$, by either pulling or pushing the jointed tubing string 19 (see FIG. 7G). When the lower isolation device 526*a* is positioned downhole from the port(s) of interest, the above described process is repeated to sample reservoir fluid from that port(s).

One of the benefits of using BHA 502 with an detachable and re-attachable lower portion is that the well operator can selectively test two or more adjacent ports simultaneously, without changing any of the components of the BHA, by strategically setting the distance between the upper and lower isolation devices 526*b*,526*a* when the lower portion of the BHA 502 is detached.

The BHAs described above are made of materials that can withstand downhole temperatures and pressures. For example, the BHAs may have a temperature tolerance range of about −30° C. to about 200° C. and a pressure tolerance range of 0 kPa to about 30,000 kPa.

Accordingly, the present disclosure provides a system for testing one or more ports in a horizontal section of a well, each of the ports having a corresponding sleeve for opening and closing same, the system comprises: a jointed tubing string deployable by a service rig, the jointed tubing string having an inner bore extending therethrough; a bottomhole assembly having a first end connectable to the jointed tubing string, the bottom hole assembly comprising: a jet pump in fluid communication with the inner bore; a pressure sealing device comprising a sealing element; a shifting tool for selectively engaging the sleeves to open or close same; and an intake for receiving fluid therethrough, the intake being in fluid communication with the jet pump; and one or both of: (i) surface testing equipment for testing the received fluid at surface and a downhole pressure and temperature recorder at or near the intake; and (ii) a production logging tool, the production logging tool being in fluid communication with the intake.

In one embodiment, the system comprises the production logging tool, and wherein the production logging tool comprises one or more of the following sensing equipment: a telemetry package, a gamma-ray detector, a casing-collar locator, a temperature probe, a fluid-capacitance sensor, a fluid-conductivity sensor, an optical sensor, a pressure probe, an optical spectroscopy sensor, a sensor for measuring ultrasonic speed within a fluid, a magnetic resonance imaging sensor package, a radioactive density measurement sensor, a fluid-resistivity sensor, a sensor for measuring dielectric properties of a fluid, a tuning-fork vibration resonance sensor for measuring the density and viscosity of a fluid.

In one embodiment, the system comprises the production logging tool, and the production logging tool comprises a memory for storing data and/or telemetry for transmitting data to surface.

The present disclosure also provides a system for testing one or more ports in a horizontal section of a well, the system comprising: a jointed tubing string deployable by a service rig, the jointed tubing string having an inner bore extending therethrough; a bottomhole assembly having a first end connectable to the jointed tubing string, the bottom hole assembly comprising: a jet pump in fluid communication with the inner bore; a pressure sealing device comprising a sealing element; a casing collar locator; an extension tubing; an intake for receiving fluid therethrough, the intake being in fluid communication with the jet pump via the extension tubing; and an isolation device comprising an upper portion having an upper sealing element and a lower portion having a lower sealing element, wherein the intake is positioned between the upper and lower portions; and one or both of: (i) surface testing equipment for testing the received fluid at surface; and (ii) a production logging tool, the production logging tool being in fluid communication with the intake.

In one embodiment, the bottomhole assembly further comprises one or more of: an upper gauge sub, a lower gauge sub, and a guide shoe.

In one embodiment, the sealing element, the upper sealing element, and/or the lower sealing element is an active-type seal. In another embodiment, the sealing element, the upper sealing element, and/or the lower sealing element is a passive-type seal.

In one embodiment, the system comprises the production logging tool, and wherein the production logging tool comprises one or more of the following sensing equipment: a telemetry package, a gamma-ray detector, a casing-collar locator, a temperature probe, a fluid-capacitance sensor, a fluid-conductivity sensor, an optical sensor, a pressure probe, an optical spectroscopy sensor, a sensor for measuring ultrasonic speed within a fluid, a magnetic resonance imaging sensor package, a radioactive density measurement sensor, a fluid-resistivity sensor, a sensor for measuring dielectric properties of a fluid, a tuning-fork vibration resonance sensor for measuring the density and viscosity of a fluid.

In one embodiment, the system comprises the production logging tool, and wherein the production logging tool comprises a memory, a pressure and/or temperature sensor, an acoustic density sensor, a fluid capacitance sensor, and a continuous flow meter.

In one embodiment, the system comprises the production logging tool, and wherein the production logging tool comprises a memory for storing data and/or telemetry for transmitting data to surface.

In one embodiment, the bottomhole assembly further comprises an on/off tool for selectively detaching the lower portion from the upper portion and re-attaching the lower portion to the upper portion.

The present disclosure further provides a method for testing inflowing fluid from one or more test ports in a well, the one or more test ports being in an open position, the method comprising: connecting a bottomhole assembly to a jointed tubing string, the bottomhole assembly comprising a jet pump, a pressure sealing device, and an intake in fluid communication with the jet pump; running the jointed tubing string and the bottom hole assembly into the well using a service rig until the bottom hole assembly reaches the one or more test ports; if there are one or more closeable ports uphole from the one or more test ports, closing the one or more closeable ports while the bottomhole assembly advances into the well; setting the pressure sealing device, the pressure sealing device being uphole from the one or more test ports; supplying power fluid to the jet pump to draw the inflowing fluid into the intake; combining the inflowing fluid received through the intake with the power fluid to form a return fluid; transporting the return fluid to surface; and one or both of: testing the inflowing fluid as it flows through the bottomhole assembly; and testing the inflowing fluid at surface using surface testing equipment.

In one embodiment, the method further comprises unsetting the pressure sealing device.

In one embodiment, the method further comprises closing the one or more test ports. The method may further comprise moving the bottomhole assembly uphole or downhole after unsetting the pressure sealing device.

In one embodiment, the power fluid is supplied through an inner bore of the jointed tubing string and the return fluid is transported to surface through an annulus defined between an inner surface of the well and an outer surface of the jointed tubing string.

In another embodiment, the power fluid is supplied through an annulus defined between an inner surface of the well and an outer surface of the jointed tubing string and the return fluid is transported to surface through an inner bore of the jointed tubing string.

In one embodiment, the method further comprises selectively closing or performing a water shut-off treatment on one or more of the one or more test ports and/or the one or more closeable ports.

The present disclosure also provides a method for testing inflowing fluid from one or more test ports in a well, the one or more test ports being in an open position, the method comprising: connecting a bottomhole assembly to a jointed tubing string, the bottomhole assembly comprising a jet pump, a pressure sealing device, an isolation device comprising an upper portion and a lower portion; and an intake in fluid communication with the jet pump via an extension tubing, the intake being positioned between the upper and lower portions; running the jointed tubing string and the bottom hole assembly into the well using a service rig until the lower portion is downhole from the one or more test ports; setting the lower portion of the isolation device; setting the pressure sealing device and the upper portion of the isolation device; and supplying power fluid to the jet pump to draw the inflowing fluid into the intake; combining the inflowing fluid received through the intake with the power fluid to form a return fluid; transporting the return fluid to surface; and one or both of: testing the inflowing fluid as it flows through the bottomhole assembly; and testing the inflowing fluid at surface using surface testing equipment.

In one embodiment, the method further comprises, after testing the inflowing fluid, unsetting the pressure sealing device and the isolation device. In one embodiment, the method further comprises moving the bottomhole assembly uphole or downhole after unsetting the pressure sealing device and the isolation device.

In one embodiment, the method further comprises, after setting the lower portion and prior to setting the pressure sealing device and the upper portion, detaching the upper portion from the lower portion; and moving the remaining bottomhole assembly above the upper portion uphole until the upper portion is uphole from the one or more test ports. In one embodiment, the method further comprises, after testing the inflowing fluid, unsetting the pressure sealing device and the upper portion; moving the remaining bottomhole assembly downhole until in contact with the lower portion; and re-attaching the upper portion to the lower portion. In one embodiment, the method further comprises, after re-attaching the upper portion to the lower portion, unsetting the lower portion and moving the bottomhole assembly uphole or downhole.

In one embodiment, the power fluid is supplied through an inner bore of the jointed tubing string and the return fluid is transported to surface through an annulus defined between an inner surface of the well and an outer surface of the jointed tubing string.

In another embodiment, the power fluid is supplied through an annulus defined between an inner surface of the well and an outer surface of the jointed tubing string and the return fluid is transported to surface through an inner bore of the jointed tubing string.

In one embodiment, the method further comprises selectively closing or performing a water shut-off treatment on one or more of the one or more test ports.

The present disclosure further provides, a system for performing a water shut-off treatment on one or more ports in a well, the system comprising: a jointed tubing string deployable by a service rig, the jointed tubing string having an inner bore extending therethrough; and a bottomhole assembly having a first end connectable to the jointed tubing string, the bottom hole assembly comprising: a casing collar locator; an outlet in fluid communication with jointed tubing string; and an isolation device comprising an upper portion having an upper sealing element and a lower portion having a lower sealing element, wherein the outlet is positioned between the upper and lower portions.

In one embodiment, the bottomhole assembly further comprises one or more of: an upper gauge sub, a lower gauge sub, and a guide shoe.

In one embodiment, the upper sealing element and/or the lower sealing element is an active-type seal. In another embodiment, the upper sealing element and/or the lower sealing element is a passive-type seal.

In one embodiment, the bottomhole assembly further comprises an on/off tool for selectively detaching the lower portion from the upper portion and re-attaching the lower portion to the upper portion.

The present disclosure further provides a method for performing a water shut-off treatment on one or more ports in a well, the one or more test ports being in an open position, the method comprising: connecting a bottomhole assembly to a jointed tubing string, the bottomhole assembly comprising an isolation device comprising an upper portion and a lower portion; and an outlet in fluid communication with the jointed tubing string, the outlet being positioned between the upper and lower portions; running the jointed tubing string and the bottom hole assembly into the well using a service rig until the lower portion is downhole from the one or more ports; setting the lower portion of the isolation device; setting the upper portion of the isolation device; and supplying treatment fluid down the jointed tubing string and allowing the treatment fluid to flow out through the outlet for a period of time.

In one embodiment, the method further comprises, after the period of time has elapsed, unsetting the isolation device. In one embodiment, the method further comprises moving the bottomhole assembly uphole or downhole after unsetting the isolation device.

In one embodiment, the method further comprises, after setting the lower portion and prior to setting the pressure sealing device and the upper portion, detaching the upper portion from the lower portion; and moving the remaining bottomhole assembly above the upper portion uphole until the upper portion is uphole from the one or more test ports. In one embodiment, the method further comprises, after the period of time has elapsed, unsetting the upper portion; moving the remaining bottomhole assembly downhole until in contact with the lower portion; and re-attaching the upper portion to the lower portion. In one embodiment, the method further comprises, after re-attaching the upper portion to the lower portion, unsetting the lower portion and moving the bottomhole assembly uphole or downhole.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed is:

1. A method for testing inflowing fluid from one or more test ports in a well, the one or more test ports being in an open position, the method comprising:

connecting a bottomhole assembly to a jointed tubing string, the bottom hole assembly comprising a jet pump, a pressure sealing device, and an intake in fluid communication with the jet pump;

running the jointed tubing string and the bottomhole assembly into the well using a service rig until the bottomhole assembly reaches the one or more test ports;

if there are one or more closeable ports uphole from the one or more test ports, closing the one or more closeable ports while the bottomhole assembly advances into the well;

setting the pressure sealing device, the pressure sealing device being uphole from the one or more test ports;

supplying power fluid to the jet pump to draw the inflowing fluid into the intake, the power fluid being supplied through an inner bore of the jointed tubing string;

combining the inflowing fluid received through the intake with the power fluid to form a return fluid;

transporting the return fluid to surface through an annulus defined between an inner surface of the well and an outer surface of the jointed tubing string; and one or both of: testing the inflowing fluid as it flows through the bottom hole assembly; and testing the inflowing fluid at surface using surface testing equipment.

2. The method of claim 1, further comprising unsetting the pressure sealing device.

3. The method of claim 1, further comprising closing the one or more test ports.

4. The method of claim 2, further comprising moving the bottom hole assembly uphole or downhole after unsetting the pressure sealing device.

5. The method claim 4, further comprising selectively closing or performing a water shut-off treatment on one or more of the one or more test ports and/or the one or more closeable ports.

6. The method of claim 1, wherein the bottom hole assembly further comprises an isolation device comprising an upper portion and a lower portion; and an outlet in fluid communication with the jointed tubing string, the outlet being positioned between the upper and lower portions, and the method further comprises:

running the jointed tubing string and the bottomhole assembly into the well using the service rig until the lower portion is downhole from one or more ports;

setting the lower portion of the isolation device;

setting the upper portion of the isolation device; and supplying treatment fluid down the jointed tubing string and allowing the treatment fluid to flow out through the outlet for a period of time.

7. The method of claim 6, further comprising, after the period of time has elapsed, unsetting the isolation device.

8. The method of claim 7, further comprising moving the bottomhole assembly uphole or downhole after unsetting the isolation device.

9. The method of claim 6, further comprising, after setting the lower portion and prior to setting the pressure sealing device and the upper portion, detaching the upper portion from the lower portion; and moving the remaining bottom hole assembly above the upper portion uphole until the upper portion is uphole from the one or more test ports.

10. The method of claim 9, further comprising, after the period of time has elapsed, unsetting the upper portion; moving the remaining bottomhole assembly downhole until in contact with the lower portion; and re-attaching the upper portion to the lower portion.

11. The method of claim 10, further comprising, after re-attaching the upper portion to the lower portion, unsetting the lower portion and moving the bottomhole assembly uphole or downhole.

12. A method for testing inflowing fluid from one or more test ports in a well, the one or more test ports being in an open position, the method comprising:

connecting a bottomhole assembly to a jointed tubing string, the bottomhole assembly comprising a jet pump, a pressure sealing device, an isolation device comprising an upper portion and a lower portion; and an intake in fluid communication with the jet pump via an extension tubing, the intake being positioned between the upper and lower portions;

running the jointed tubing string and the bottomhole assembly into the well using a service rig until the lower portion is downhole from the one or more test ports;

setting the lower portion of the isolation device;

setting the pressure sealing device and the upper portion of the isolation device;

supplying power fluid to the jet pump to draw the inflowing fluid into the intake, the power fluid being supplied through an inner bore of the jointed tubing string;

combining the inflowing fluid received through the intake with the power fluid to form a return fluid;

transporting the return fluid to surface through an annulus defined between an inner surface of the well and an outer surface of the jointed tubing string; and one or both of: testing the inflowing fluid as it flows through the bottom hole assembly; and testing the inflowing fluid at surface using surface testing equipment.

13. The method of claim 12, further comprising, after testing the inflowing fluid, unsetting the pressure sealing device and the isolation device.

14. The method of claim 13, further comprising moving the bottom hole assembly uphole or downhole after unsetting the pressure sealing device and the isolation device.

15. The method of claim 12, further comprising, after setting the lower portion and prior to setting the pressure sealing device and the upper portion, detaching the upper portion from the lower portion; and moving the remaining bottom hole assembly above the upper portion uphole until the upper portion is uphole from the one or more test ports.

16. The method of claim 15, further comprising, after testing the inflowing fluid, unsetting the pressure sealing device and the upper portion; moving the remaining bottomhole assembly downhole until in contact with the lower portion; and re-attaching the upper portion to the lower portion.

17. The method of claim 16, further comprising, after re-attaching the upper portion to the lower portion, unsetting the lower portion and moving the bottomhole assembly uphole or downhole.

18. The method claim 14, further comprising selectively closing or performing a water shut-off treatment on one or more of the one or more test ports.

19. A method for testing inflowing fluid from one or more test ports in a well, the one or more test ports being in an open position, the method comprising:

connecting a bottomhole assembly to a jointed tubing string, the bottomhole assembly comprising a jet pump, a pressure sealing device, and an intake in fluid communication with the jet pump;

running the jointed tubing string and the bottomhole assembly into the well using a service rig until the bottomhole assembly reaches the one or more test ports;

if there are one or more closeable ports uphole from the one or more test ports, closing the one or more closeable ports while the bottomhole assembly advances into the well;

setting the pressure sealing device, the pressure sealing device being uphole from the one or more test ports;

supplying power fluid to the jet pump to draw the inflowing fluid into the intake, the power fluid being supplied through an annulus defined between an inner surface of the well and an outer surface of the jointed tubing string;

combining the inflowing fluid received through the intake with the power fluid to form a return fluid; and transporting the return fluid to surface through an inner bore of the jointed tubing string; and one or both of: testing the inflowing fluid as it flows through the bottom hole assembly; and testing the inflowing fluid at surface using surface testing equipment.

20. The method of claim 19, further comprising unsetting the pressure sealing device.

21. The method of claim 20, further comprising moving the bottomhole assembly uphole or downhole after unsetting the pressure sealing device.

22. The method claim 21, further comprising selectively closing or performing a water shut-off treatment on one or more of the one or more test ports and/or the one or more closeable ports.

23. The method of claim 19, further comprising closing the one or more test ports.

* * * * *